US007841373B2

(12) United States Patent
Rastatter et al.

(10) Patent No.: US 7,841,373 B2
(45) Date of Patent: Nov. 30, 2010

(54) APPARATUS FOR SURFACING FLITCH

(75) Inventors: Daniel J. Rastatter, Beaver Falls, PA (US); Juergen F. Trost, Columbiana, OH (US)

(73) Assignee: Padana AG, Baar (CH)

( * ) Notice: Subject to any disclaimer, the term of this patent is extended or adjusted under 35 U.S.C. 154(b) by 0 days.

(21) Appl. No.: 12/183,202

(22) Filed: Jul. 31, 2008

(65) Prior Publication Data

US 2008/0283149 A1 Nov. 20, 2008

Related U.S. Application Data

(62) Division of application No. 10/503,703, filed as application No. PCT/US03/04843 on Feb. 19, 2003, now abandoned.

(60) Provisional application No. 60/358,155, filed on Feb. 20, 2002.

(51) Int. Cl.
*B27L 5/00* (2006.01)
*B27L 1/00* (2006.01)

(52) U.S. Cl. ..... 144/209.1; 144/208.1; 144/208.8; 144/162.1

(58) Field of Classification Search ... 144/209.1–215.4, 144/208.1, 208.5, 208.8, 162.1, 172; 241/55; 142/31, 32; 414/14, 18
See application file for complete search history.

(56) References Cited

U.S. PATENT DOCUMENTS 1,956,653 A * 5/1934 Onstad ..... 144/208.8
2,591,751 A * 4/1952 Whitlock ..... 144/208.8
2,794,465 A * 6/1957 Gyllenberg ..... 144/208.7
2,798,519 A * 7/1957 Hansel ..... 144/208.8
2,899,993 A * 8/1959 Durant ..... 144/208.5
3,119,422 A * 1/1964 Brown ..... 144/208.8
3,333,615 A * 8/1967 Robbins ..... 144/208.8
3,913,644 A * 10/1975 Braun ..... 144/208.8
4,122,877 A * 10/1978 Smith et al. ..... 144/208.8
4,519,429 A * 5/1985 Dreese ..... 144/4.1
4,562,873 A * 1/1986 Krocher et al. ..... 144/356
4,566,371 A * 1/1986 Jorgensen et al. ..... 92/92
4,673,012 A * 6/1987 O'Brien, Jr. et al. ..... 144/208.8
4,844,201 A * 7/1989 Ackerman ..... 184/6
5,117,881 A * 6/1992 Simpson ..... 144/341
5,622,213 A * 4/1997 McKelvie ..... 144/246.2
5,722,475 A * 3/1998 Lammi ..... 144/363
5,996,656 A * 12/1999 Fezer ..... 144/178
6,135,174 A * 10/2000 Neville ..... 144/4

* cited by examiner

*Primary Examiner*—Shelley Self
(74) *Attorney, Agent, or Firm*—Barnes & Thornburg LLP

(57) ABSTRACT

An apparatus for surfacing a flitch by cutting material from its radially outer surface to prepare the flitch for veneer slicing or other uses. The apparatus comprises a cutterhead rotatable about a cutterhead axis. The apparatus further comprises a carriage comprising a ring that rotates about a carriage axis and a pivot arm that carries the cutterhead and is coupled to the rotatable ring for pivoting movement about a pivot arm axis. The apparatus further comprises a flitch contour accommodation device coupled to the pivot arm and to the cutterhead to permit rotation of the cutterhead about a device axis that is generally transverse to the cutterhead axis.

5 Claims, 18 Drawing Sheets

APPARATUS FOR SURFACING FLITCH

CROSS REFERENCE TO RELATED APPLICATIONS

This application is a divisional of U.S. Ser. No. 10/503,703 filed Aug. 5, 2004, now abandoned, which is the U.S. national phase of PCT/US2003/04843 filed Feb. 19, 2003. PCT/US2003/04843 claims the benefit under 35 U. S. C. §119 of the Feb. 20, 2002 filing date of U.S. Ser. No. 60/358,155. The complete disclosures of U.S. Ser. No. 60/358,155, PCT/US2003/04843 and U.S. Ser. No. 10/503,703 are hereby expressly incorporated by reference herein.

BACKGROUND

The present disclosure relates to apparatus for surfacing a flitch to prepare the flitch for veneer slicing or other uses.

A flitch is a longitudinal section of a wood log. It is provided by cutting the log in half longitudinally along a diameter of the log.

A flitch may be used for a variety of purposes. For example, a flitch may be cut to provide sheets of veneer. To prepare the flitch for such veneer slicing or other uses, the flitch may be surfaced by cutting material from its radially outer surface.

SUMMARY

The present invention comprises one or more of the following features or combinations thereof. An apparatus for surfacing a flitch by cutting material from its radially outer surface to prepare the flitch for veneer slicing or other uses is provided. The apparatus comprises a cutterhead and a cutterhead mover to move the cutterhead on the flitch circumferentially thereabout for the cutterhead to cut material from the radially outer surface of the flitch.

According to one aspect of the invention, the cutterhead mover comprises a cutterhead oscillator. The cutterhead oscillator oscillates the cutterhead about the flitch to cut material from the radially outer surface of the flitch.

Other features of the cutterhead oscillator may involve oscillating the cutterhead about an oscillation axis. A cam and a cam follower that follows the cam may be used to oscillate the cutterhead about the oscillation axis. The cutterhead may be mounted to a pivot arm for movement about a pivot axis radially toward and radially away from the radially outer surface of the flitch. The pivot axis may be parallel to the oscillation axis. The cutterhead mover may further comprise another cutterhead oscillator to oscillate the cutterhead about another oscillation axis transverse to the cutterhead.

According to another aspect of the invention, the cutterhead mover comprises a rotatable carriage to rotate the cutterhead therewith about the flitch to cut material from the radially outer surface of the flitch. The carriage comprises a ring configured to surround the flitch for rotation of the cutterhead about the flitch.

Other features associated with the aspect of the invention relating to the rotatable carriage include a ring rotator to rotate the ring. The ring rotator may comprise a drive wheel engaging the ring and a motor to rotate the drive wheel. The carriage may comprise a pivot arm supporting the cutterhead for movement about a pivot axis. High pressure and low pressure air bags may be used to control movement of the pivot arm and cutterhead radially away from and radially toward the radially outer surface. The low pressure air bag may be maintained at a constant pressure by a pressure regulator for the pivot arm to press the cutterhead against the flitch at a constant pressure.

The apparatus may further comprise a flitch support. The flitch support may comprise an infeed conveyor device to feed the flitch past the cutterhead and an outfeed conveyor device to carry the flitch away from the cutterhead after surfacing of the flitch thereby. A centering device may be used to center the flitch as it approaches the cutterhead on the infeed conveyor device. Downwardly acting infeed and outfeed press-roll devices may be used on either side of the cutterhead to press the flitch against the infeed and outfeed conveyor devices, respectively, to maintain the flitch in a desired orientation for cutting by the cutterhead.

A flitch contour accommodation device may be used to allow movement of the cutterhead in response to changes in the contour of the radially outer surface of the flitch. A locking device may be configured for movement either to allow such cutterhead movement or block such cutterhead movement.

The cutterhead comprises a cutterhead shaft and at least one knife mounted for rotation therewith about a cutterhead axis defined by the cutterhead shaft to cut material from the radially outer surface of the flitch. The cutterhead axis may be positionable parallel to or transverse to an axis about which the cutterhead mover moves the cutterhead.

Additional features and advantages of the apparatus will become apparent to those skilled in the art upon consideration of the following detailed description exemplifying the best mode of the disclosure as presently perceived.

BRIEF DESCRIPTIONS OF THE DRAWINGS

The detailed description particularly refers to the accompanying figures in which.

Figure 23:
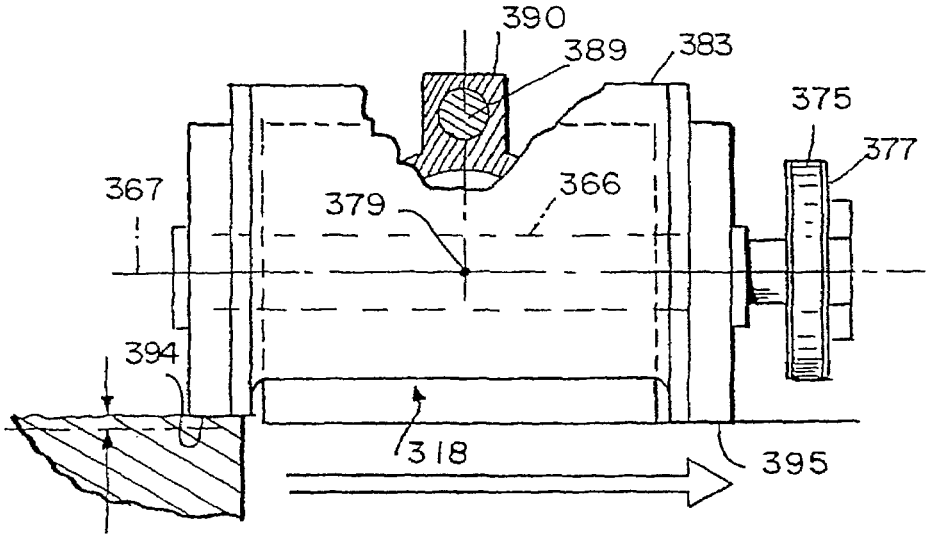
FIG. 23 is a fragmentary end elevation view of a cutterhead showing an associated locking member in its locking position to block rotation of the cutterhead about an axis perpendicular to the page when an infeed cut-depth limiter is positioned on the flitch radially outer surface and an outfeed cut-depth limiter is not positioned thereon.
Figure 24:
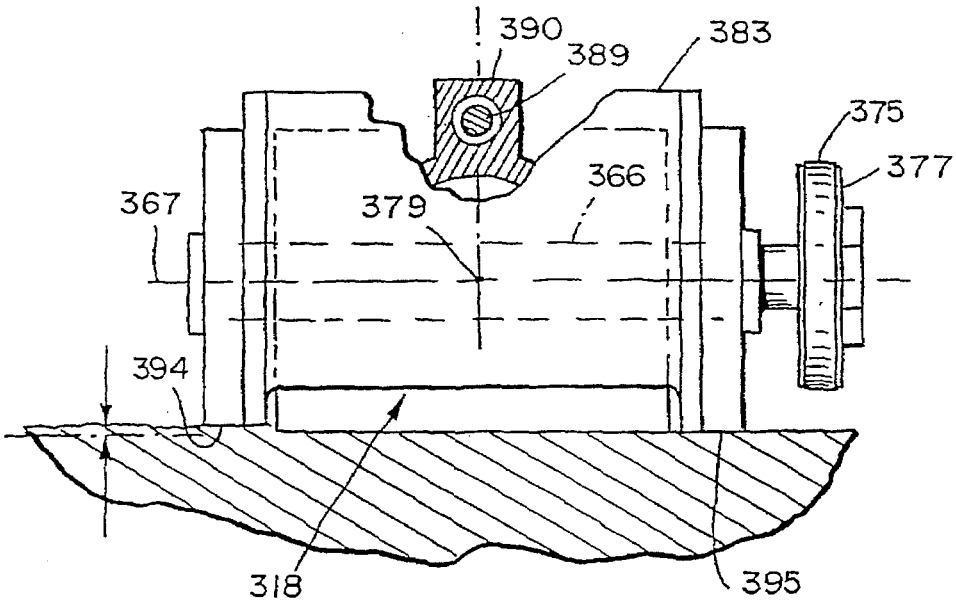
FIG. 24 is a fragmentary end elevation view similar to FIG. 23 showing the locking member in its unlocking position to allow rotation of the cutterhead about the axis when the infeed and outfeed cut-depth limiters are positioned on the flitch radially outer surface.
Figure 25:
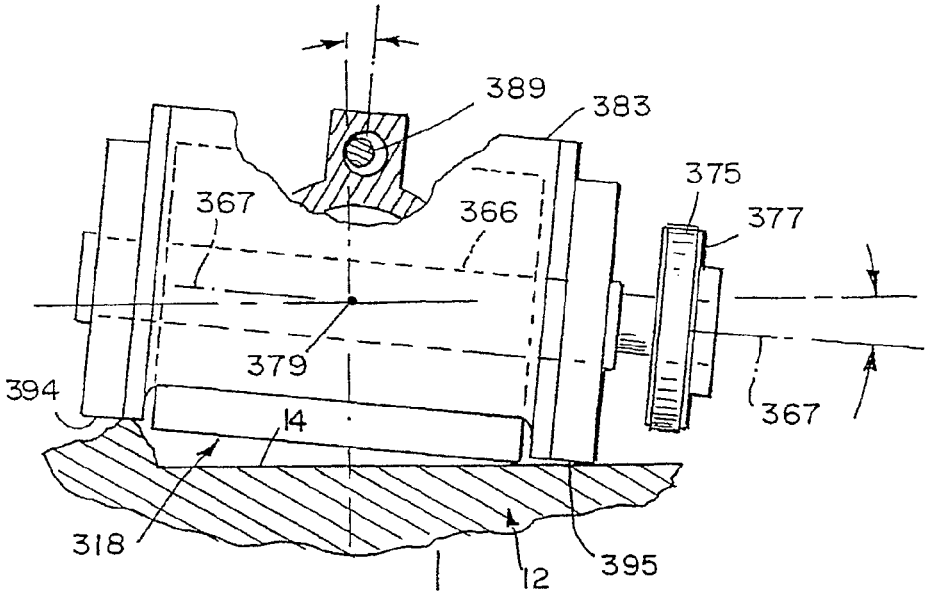
Figure 26:
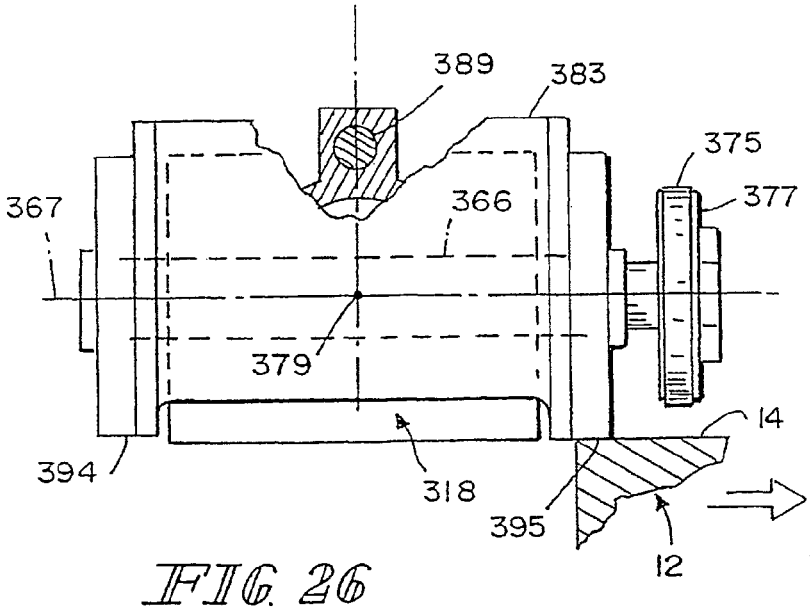

FIG. 25 is a fragmentary end elevation view similar to FIG. 24 showing the cutterhead after rotation about the axis in response to a change in the contour of the flitch radially outer surface; and FIG. 26 is a fragmentary end elevation view similar to FIG. 23 showing the locking member in its locking position to block rotation of the cutterhead about the axis when the outfeed cut-depth limiter, but not the infeed cut-depth limiter, is positioned on the flitch radially outer surface.

DETAILED DESCRIPTIONS OF ILLUSTRATIVE EMBODIMENTS

Figures 1, 6:
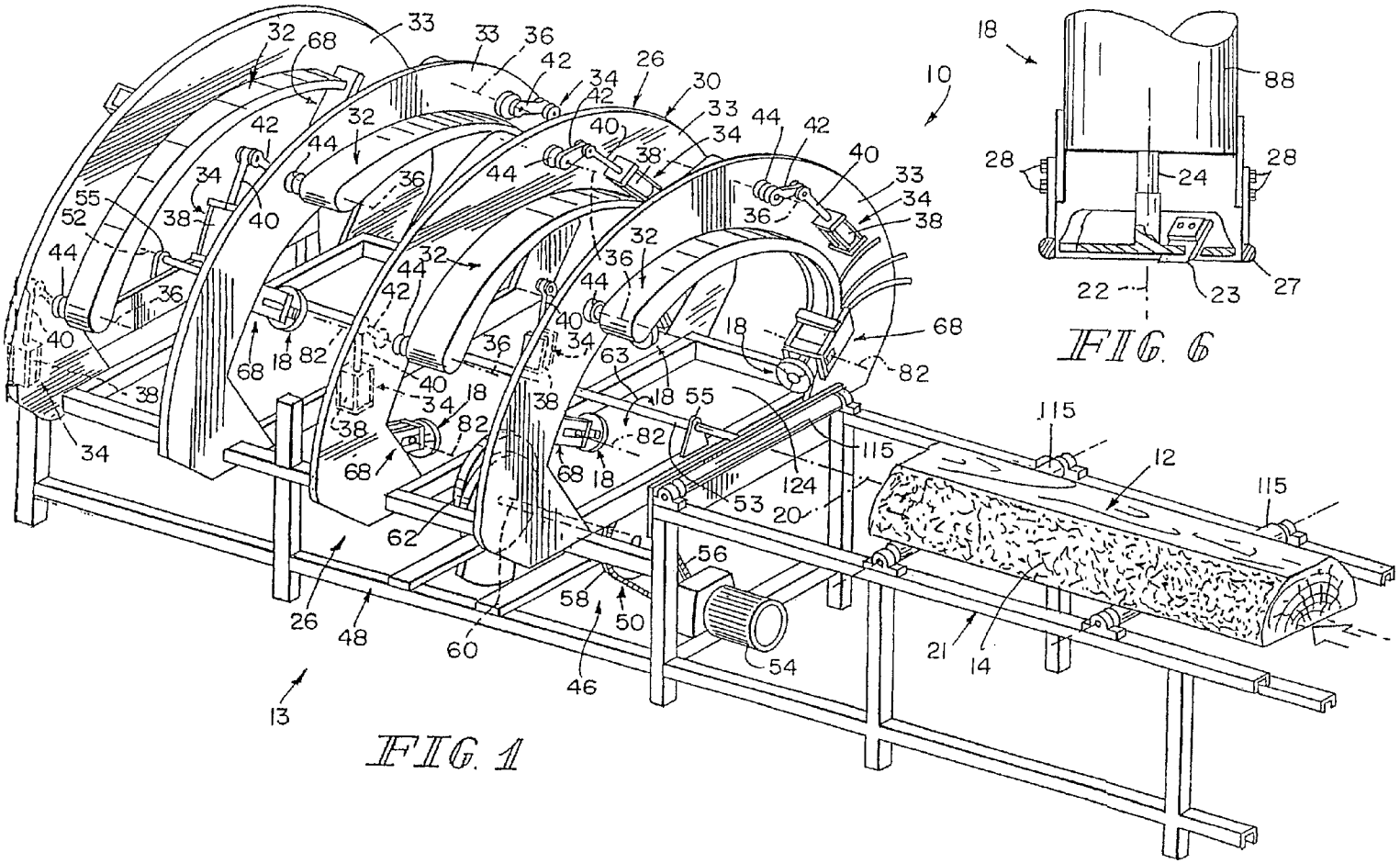
FIG. 1 is a perspective view showing an apparatus for surfacing a flitch and showing the apparatus comprising a flitch surfacer comprising a cutterhead oscillator to oscillate cutterheads about the flitch to cut material from its radially outer surface.
FIG. 6 is a sectional view, taken along lines 6-6 of FIG. 4, of a cutterhead.

An apparatus 10 for surfacing a flitch 12 to prepare the flitch 12 for veneer slicing or other purposes is illustrated, for example, in FIG. 1. Apparatus 10 comprises a flitch surfacer 13 for surfacing the flitch 12 by cutting material from a radially outer surface 14 thereof.

Flitch surfacer 13 comprises at least one cutterhead 18 and a cutterhead mover 24 to move the cutterhead 18 on the flitch 12 circumferentially thereabout to cut material from the surface 14, as illustrated in FIG. 1. The cutterhead mover 24 may be referred to, for example, as a cutterhead oscillator since it is configured to oscillate the cutterhead 18 on the flitch 12 circumferentially thereabout to cut material from the surface 14. Illustratively, the flitch surfacer 13 comprises eight cutterheads 18. The cutterheads 18 are spaced circumferentially about and axially along an oscillation axis 20 about which the cutterhead oscillator 24 oscillates the cutterheads 18. The axis 20 is generally coextensive with a central longitudinal axis 20 of a flitch support 21 of apparatus 10 and parallel to a central longitudinal axis 99 of the flitch 12. It is within the scope of this disclosure for the flitch surfacer 13 to have any number of cutterheads 18.

Figure 2:
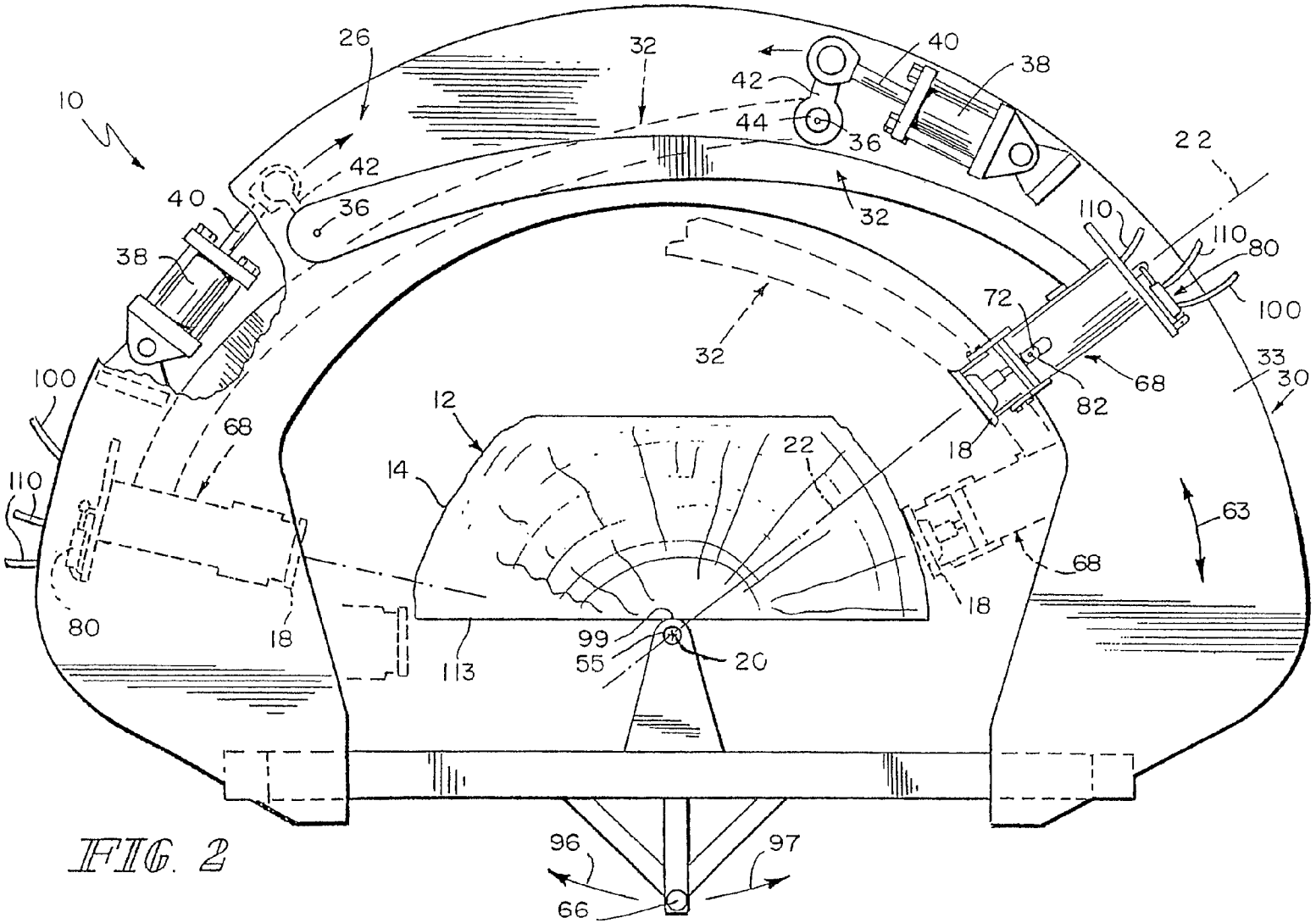
FIG. 2 is a fragmentary outfeed elevation view of a carriage of the cutterhead oscillator of FIG. 1 showing the carriage carrying the cutterheads.
Figure 3:
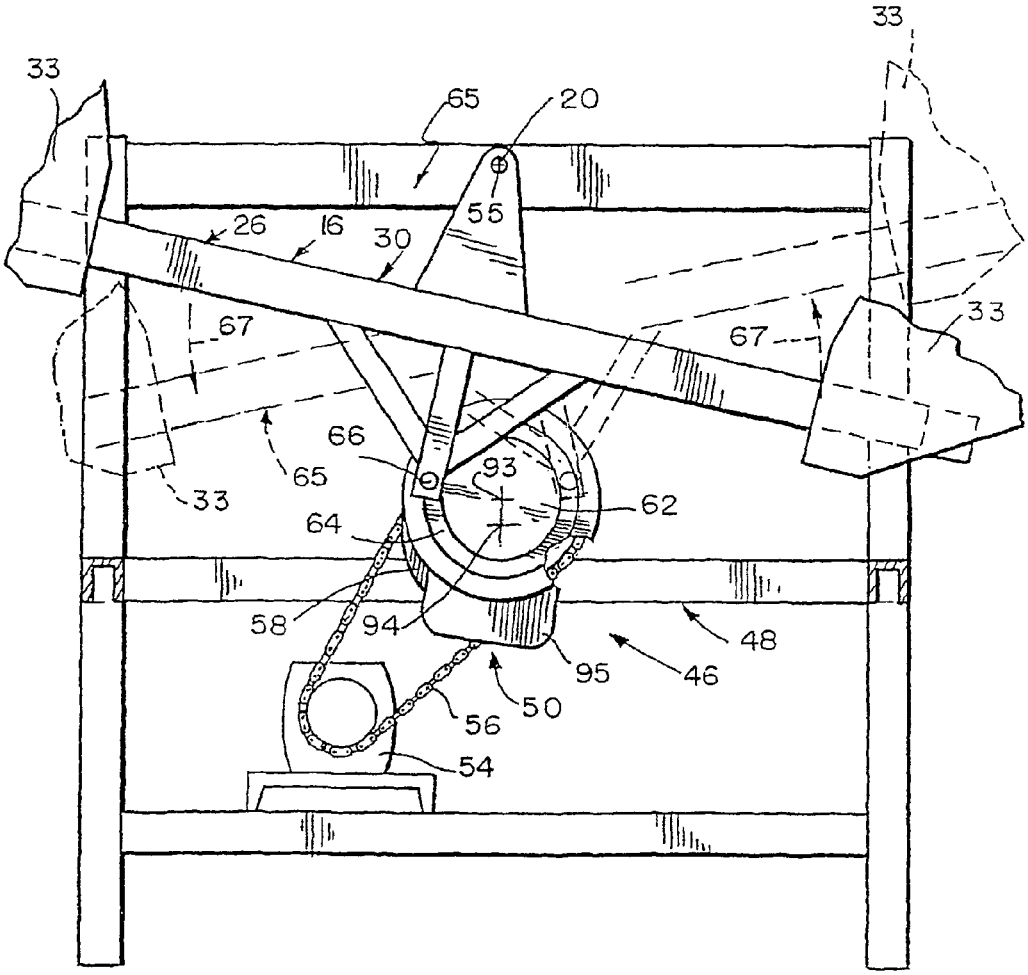
FIG. 3 is a fragmentary outfeed elevation view showing a carriage oscillator to oscillate the carriage.

The cutterhead oscillator 24 comprises a carriage 26 to carry the cutterheads 18 and a carriage support 46, as shown in FIGS. 1-3. Carriage 26 comprises a carriage frame 30 and a plurality of pivot arms 32. Carriage frame 30 comprises a plurality of support plates 33. Each support plate 33 supports two pivot arms 32, one pivot arm 32 on each side of support plate 33. Each pivot arm 32 carries one of cutterheads 18 for movement thereof about a pivot axis 36.

A pivot arm mover 34 is coupled to each pivot arm 32 to move the pivot arm 32 and the cutterhead 18 coupled thereto about a pivot axis 36 radially toward and radially away from surface 14, as illustrated, for example, in FIGS. 1 and 2. Each pivot arm mover 34 is coupled to one of support plates 33. Each pivot axis 36 is parallel to axis 20.

Each pivot arm mover 34 comprises a pneumatic cylinder 38 coupled to its associated support plate 33, a piston 40 coupled to cylinder 38, a crank arm 42 coupled to piston 40, and a shaft 44 coupled to crank arm 42 and pivot arm 32, as illustrated, for example, in FIGS. 1 and 2. Shaft 44 extends through an aperture in support plate 33 such that support plate 33 supports shaft 44. Movement of piston 40 causes crank arm 42 to rotate shaft 44. Rotation of shaft 44 causes corresponding pivoting of pivot arm 32.

The carriage support 46 is configured to support and oscillate the carriage 26, as illustrated, for example, in FIGS. 1 and 3. Carriage support 46 comprises a base 48 and a carriage oscillator 50. Carriage 26 is mounted on base 48 and oscillates about axis 20 in response to movement of carriage oscillator 50. Carriage frame 30 comprises a shaft 53 that defines axis 20. Shaft 53 is mounted to a pair of bearings 55 of base 48 for rotation therein.

Carriage oscillator 50 comprises a motor 54, a chain 56, a sprocket 58, a shaft 60, and a cam 62, as illustrated, for example, in FIGS. 1 and 3. Chain 56 is coupled to motor 54 and sprocket 58. Shaft 60 is coupled to sprocket 58 and cam 62. Cam 62 comprises a track 64. A cam follower 66, such as a roller, of carriage frame 30 is positioned within an arcuate track 64 for movement therein as motor 54 causes cam 62 to rotate via chain 56, sprocket 58, and shaft 60. Track 64 is centered on an axis 93 that is offset from an axis 94 of shaft 60, as illustrated, for example, in FIG. 3, so that axis 93 oscillates about axis 94 as cam 62 rotates about axis 94. A counterweight 95 is coupled to cam 62 to counterbalance cam 62 as it oscillates about axis 94. As cam 62 rotates about axis 94, cam follower 66 is caused to oscillate back and forth in directions indicated by arrows 96 and 97 in FIG. 2. As a result, carriage oscillator 50 causes carriage 26 to oscillate about axis 20 in directions indicated by double-headed arrow 63 in FIGS. 1 and 2. Oscillation of a portion 65 of carriage 26 about axis 20 between a solid-line orientation and a dashed-line orientation is indicated by dashed-line arrows 67 in FIG. 3. Illustratively, carriage oscillator 50 causes carriage 26 to oscillate 40 to 60 times per minute through an angle of about 22.5° to about 30°.

Oscillation of carriage 26 causes cutterheads 18 to oscillate about axis 20. As such, the cutterheads 18 move on the surface 14 circumferentially about the flitch 12 so that each cutterhead 18 cuts more material from surface 14 than if carriage 26 remained stationary.

Figure 4:
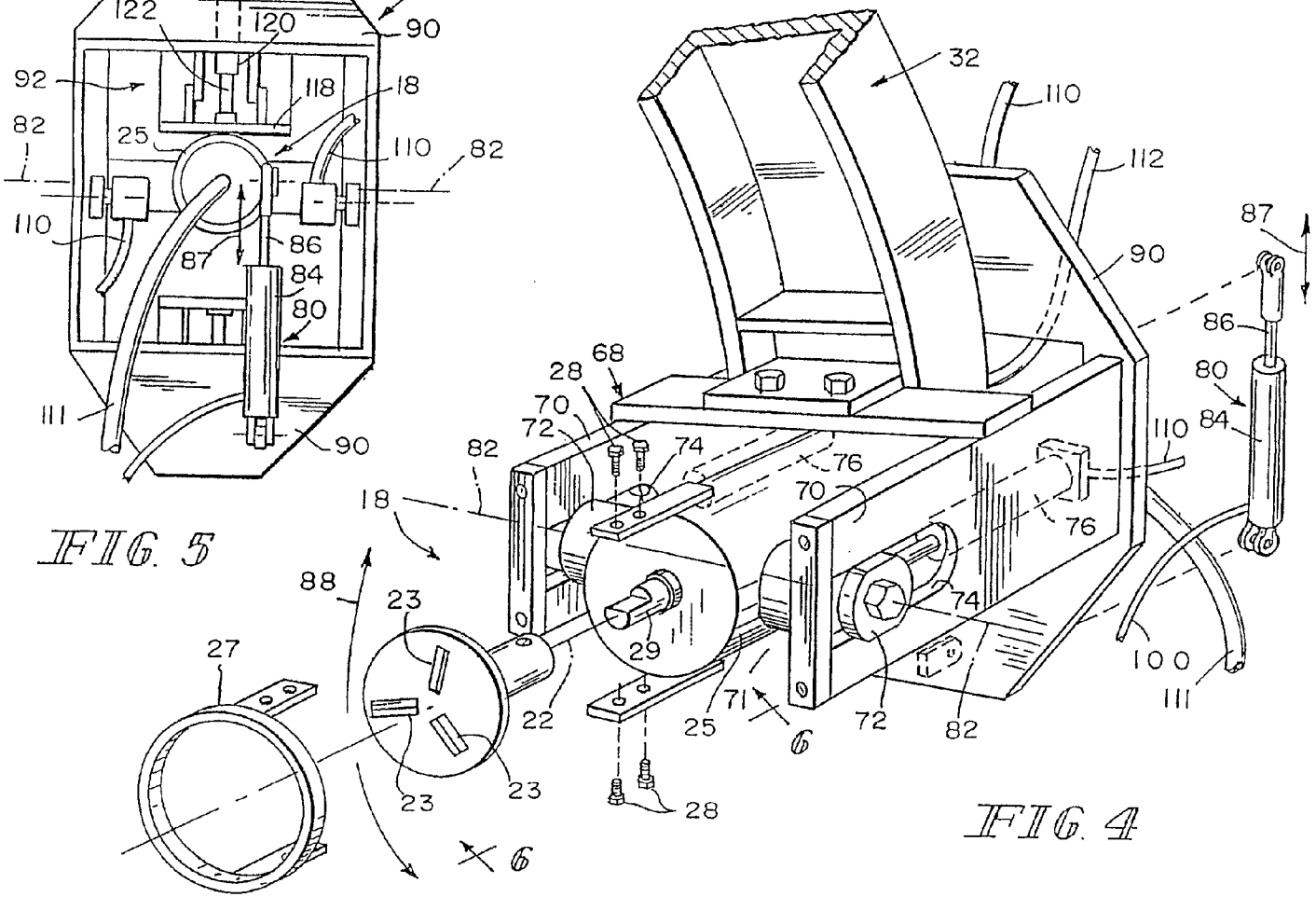
FIG. 4 is an exploded perspective view of one of the cutterheads of FIGS. 1 and 2 and components associated therewith.

Each cutterhead 18 comprises a number of knives 23 (e.g., three) and a cutterhead shaft 29 for moving knives 23 about a cutterhead axis 22, as illustrated, for example, in FIGS. 4 and 6. The cutterhead shaft 29 is supported by a pair of bearings (not illustrated) for rotation therein. A ring-shaped adjustable cut-depth limiter 27 surrounding the knives 23 is configured to establish the depth of cut of cutterhead 18. Fasteners 28 are used for adjustably coupling the cut-depth limiter 27 to a housing 25 of cutterhead 18. The cutterhead axis 22 is positionable transverse to axis 20, as illustrated in FIG. 2. Illustratively, cutterhead 18 comprises three knives 23.

Figure 7:
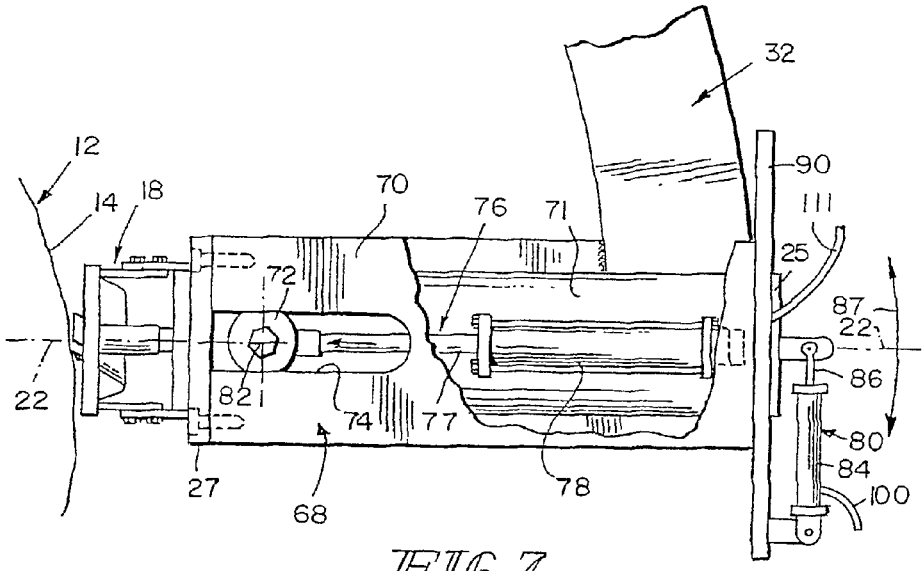
FIG. 7 is an elevation view showing a biasing mechanism biasing a cutterhead toward the flitch.
Figure 8:
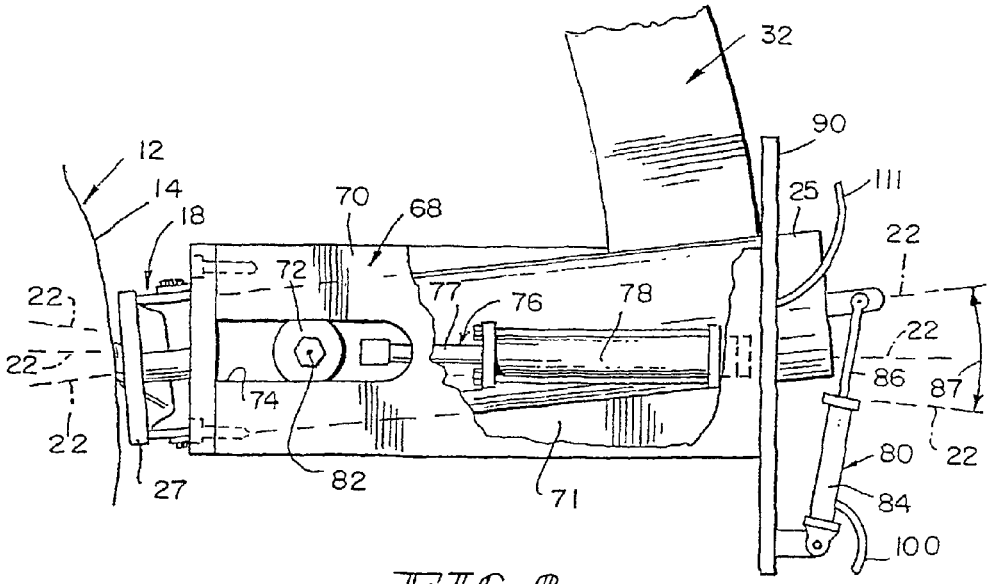
FIG. 8 is an elevation view similar to FIG. 7 showing the biasing mechanism retracted away from the cutterhead.

There is a flitch contour accommodation device 68 for each cutterhead 18 to allow movement of the cutterhead 18 in response to changes in the contour of surface 14, as illustrated, for example, in FIGS. 4, 7, and 8. The device 68 comprises a pair of plates 70 facing one another to define a cutterhead-receiving space 71 for receiving the cutterhead 18. Each plate 70 comprises an elongated slot 74 sized to receive one of a pair of bushings 72 coupled to the cutterhead housing 25 on opposite sides thereof. Each bushing 72 is movable in its slot 74 as the cutterhead encounters changes in the contour of the surface 14.

Device 68 further comprises a pair of cutterhead biasing mechanisms 76, as illustrated, for example, in FIGS. 4, 7, and 8. Each biasing mechanism 76 comprises a pneumatic cylinder 77 and a piston 78 extensible therefrom. In one mode of operation (see FIG. 7), each piston 78 is extended from its cylinder 77 and engages an associated bushing 72 to bias the cutterhead 18 toward flitch 12. In another mode of operation (see FIG. 8), each piston 78 is retracted away from its associated bushing 74 to allow the cutterhead 18 and bushings 72 to "free-float" in space 71 and slots 74, respectively. In both modes of operation, gravity assists to bias cutterhead 18 toward flitch 12.

Flitch surfacer 13 further comprises a second cutterhead oscillator 80 for each cutterhead 18 to oscillate the cutterhead 18 about an oscillation axis 82, as illustrated, for example, in FIGS. 7 and 8. The axis 82 is defined by the bushings 72 associated with the cutterhead 18 and is transverse (e.g., perpendicular) to the cutterhead 18 and its cutterhead axis 22. Oscillation of cutterhead 18 about axis 82 allows cutterhead 18 to cut more material from surface 14 than if it remained stationary relative to axis 82. Oscillation of cutterhead 18 about axis 82 also causes the cutterhead axis 22 to traverse the axis 20.

Each oscillator 80 comprises a pneumatic cylinder 84 and a piston 86, as illustrated, for example, in FIGS. 4, 5, 7, and 8. The cylinder 84 is mounted to a plate 90. The piston 86 is coupled to the cutterhead housing 25 and is configured to extend from and retract into cylinder 84 to oscillate the cutterhead 18 about the axis 82 in directions indicated by double-headed arrow 87.

Figure 5:
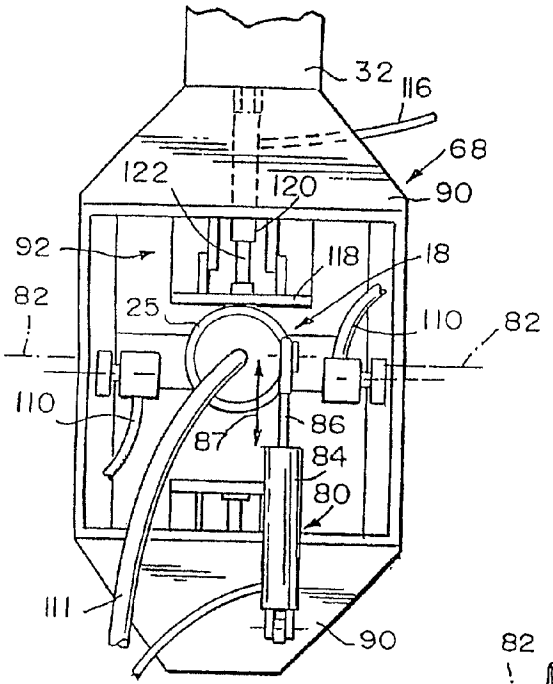
FIG. 5 is an end elevation view showing the cutterhead and associated components of FIG. 4 assembled.

An oscillation limiter 92 is associated with each cutterhead 18 to limit oscillation thereof about the axis 82, as illustrated, for example, in FIG. 5. The oscillation limiter 92 comprises a pad 118 for engaging housing 25, a cylinder 120, and a piston 122 extensible from cylinder 120 and coupled to pad 118 to selectively position pad 118 to limit oscillation of cutterhead 18.

Apparatus 10 comprises a controller (not illustrated) configured to control operation of flitch surfacer 13. The controller is coupled to motor 54 of carriage oscillator 50 to control movement of carriage 26. The controller controls lifting of pivot arm movers 34 via pneumatic lines coupled to cylinders 38 and controls oscillators 80 via pneumatic lines 100. The controller controls positioning of biasing mechanisms 67 via pneumatic lines 110 and positioning of oscillation limiters 92 via pneumatic lines 116. The controller controls the rotation of cutterhead shaft 29 and, thus, knives 23 about cutterhead axis 22 via pneumatic line 111.

To surface flitch 12, flitch 12 is placed on rollers 115 of flitch support 21, as illustrated in FIG. 1. In one embodiment, flitch 12 is moved manually over rollers 115 past cutterheads 18. In another embodiment, flitch support 21 comprises a conveyor system (not illustrated) controlled by the controller to move flitch 12 past cutterheads 18. Such a conveyor system may be configured to rotate rollers 115 to move the flitch 12. Pivot arm movers 34 lift pivot arms 32 and cutterheads 18 to allow introduction of flitch 12 into a flitch-receiving space 124. Once flitch 12 is introduced into space 124, pivot arms 32 and cutterheads 18 are allowed to lower under their own weight so that cutterheads 18 contact surface 14.

As flitch 12 moves through space 124, the cutterheads 18 cut material from surface 14. In doing so, the carriage oscillator 50 oscillates carriage 26 and thus cutterheads 18 about axis 20, the oscillators 80 oscillate the cutterheads 18 about the axes 82, and the knives 23 rotate about their cutterhead axes 22. The flitch contour accommodation devices 68 allow the cutterheads 18 to move in response to changes in the contour of surface 14. Each cutterhead 18 and its associated pivot arm 32 move on the same plane when they oscillate about axis 20 and when they move about their associated pivot axis 36. These planes are parallel to one another and perpendicular to axes 20 and 36.

Figure 9:
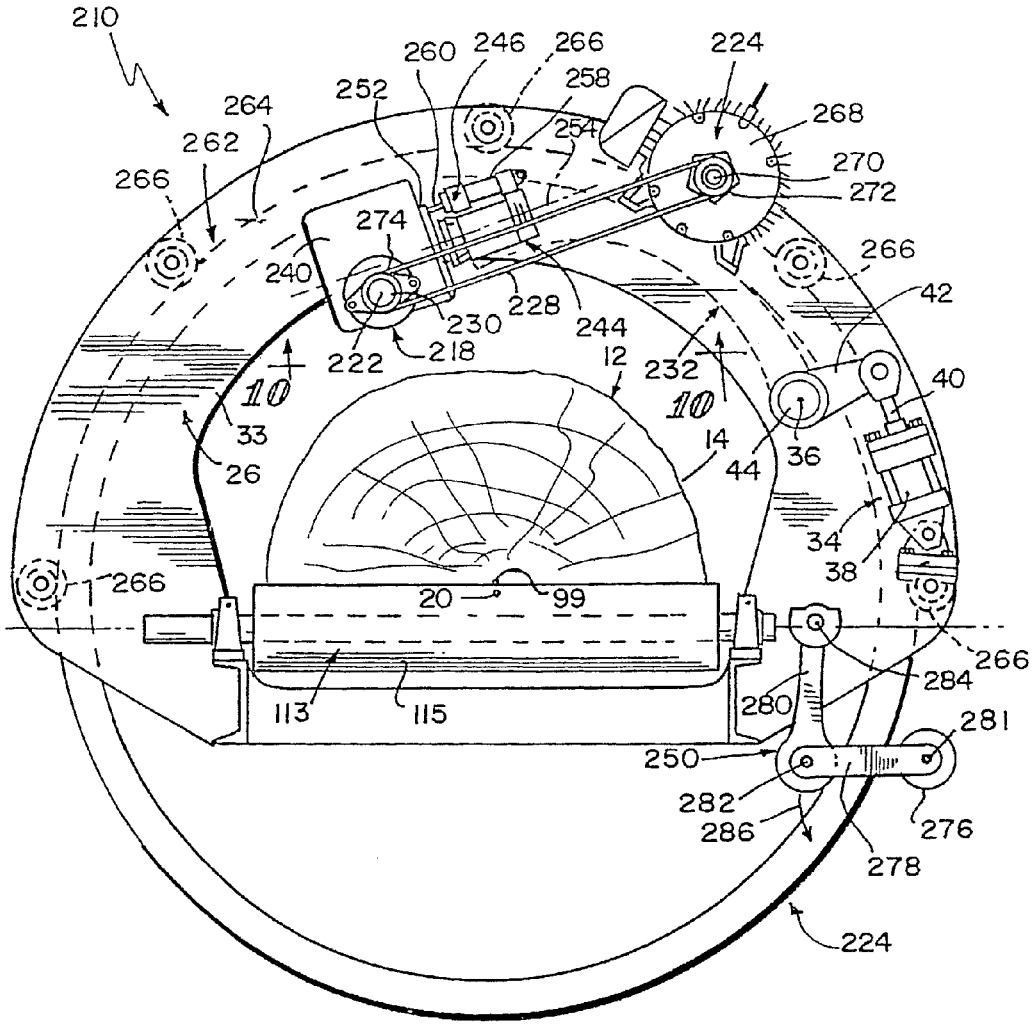
FIG. 9 is a fragmentary infeed elevation view of another apparatus for surfacing the flitch.

An apparatus 210 for surfacing the flitch 12 for veneer slicing or other purposes is illustrated, for example, in FIG. 9. The apparatus 210 is similar to apparatus 10, except as otherwise noted, so that corresponding reference characters refer to corresponding structures. Apparatus 210 comprises a plurality of cutterheads 218 which are different from cutterheads 18 in that their cutterhead axes 222 are positionable parallel to, instead of transverse to, axis 20. The cutterhead axes 222 can be positioned in other orientations as well as explained in more detail below.

Figure 10:
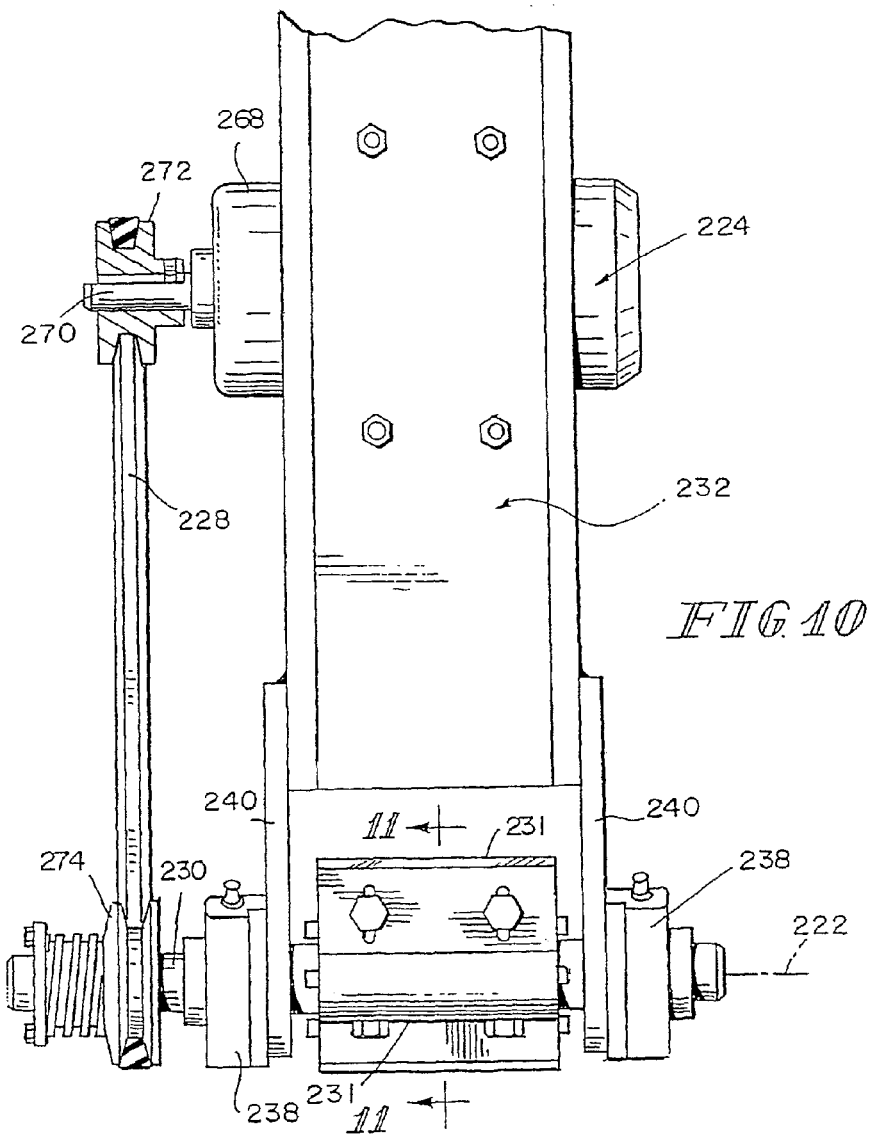
FIG. 10 is a bottom view of a portion of the apparatus of FIG. 9.
Figure 11:
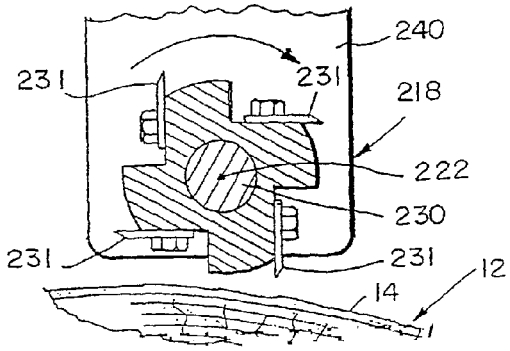
FIG. 11 is a sectional view taken along lines 11-11 of FIG. 10.

Apparatus 210 comprises a driver 224 for each cutterhead 218, as illustrated, for example, in FIGS. 9 and 10. Each driver 224 comprises a motor 268 and a drive shaft 270 coupled to motor 268. Motor 268 is mounted on one of pivot arms 232 to move therewith about pivot axis 36. Each driver 224 further comprises a connector 228, a first pulley 272, and a second pulley 274 for each cutterhead 218. First pulley 272 is coupled to drive shaft 270. Second pulley 274 is coupled to a cutterhead shaft 230 that defines axis 222 of cutterhead 218. Connector 228 is, for example, a V-belt and is wrapped around pulleys 272, 274. Cutterhead shaft 230 is configured to rotate in a pair of bearings 238 which are mounted to plates 240 coupled to pivot arm 232. Operation of motor 268 causes connector 228 to rotate cutterhead shaft 230. Rotation of cutterhead shaft 230 causes cutters 231 of cutterhead 218 to rotate about axis 222 to cut material from surface 14.

Figure 12:
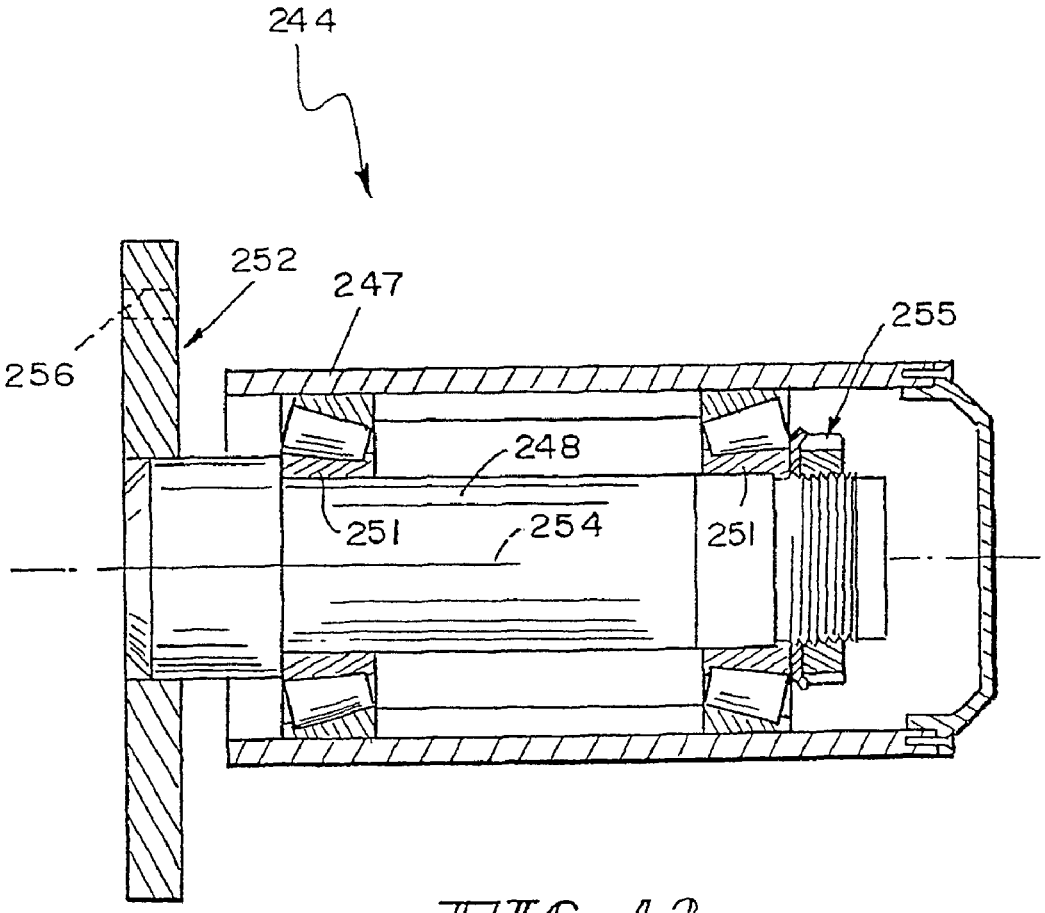
FIG. 12 is a sectional view of a flitch contour accommodation device of the apparatus of FIG. 9 to allow rotation of a cutterhead in response to changes in the contour of the radially outer surface of the flitch.

Referring to FIG. 12, there is a flitch contour accommodation device 244 for each cutterhead 218 to allow rotation of the cutterhead 218 about a device axis 254 in response to changes in the contour of surface 14. The device 244 comprises a housing 247, a device shaft 248, a pair of tapered bearings 251, and a support plate 252. Housing 247 is fixed to an end of an associated pivot arm 232. Plate 252 is fixed to the cutterhead 218. Shaft 248 is fixed to the plate 252 and extends through bearings 251 positioned between the housing 247 and the shaft 248 for rotation of the shaft 248 inside the housing 247 for rotation of the cutterhead about the device axis 254 in response to changes in the contour of the surface 14. A retainer assembly 255 comprises a nut and washer to retain one of the bearings 251 on the shaft 248. Illustratively, the bearings 251 are tapered bearings.

A locking device 246 illustrated in FIG. 9 is provided for each cutterhead 218 to block rotation thereof that could be caused by changes in the contour of the surface 14. The locking device 246 comprises a cylinder 258, a locking member 260, and a locking member receiver 256 (see FIG. 12). Locking member receiver 256 is, for example, an aperture formed in plate 252. Cylinder 258 is mounted to housing 247 and is configured to move member 260 between a locking position in which member 260 extends into aperture 256 to block rotation of cutterhead about device axis 254 and an unlocking position in which member 260 is retracted out of aperture 256 to allow rotation of cutterhead 218 about device axis 254.

The position of member 260 is based on the position of the flitch 12. Member 260 is extended to its locking position when the cutterhead 218 moves onto a leading portion of flitch 12 and when the cutterhead 218 moves off a trailing portion of flitch 12 to prevent gouging of the flitch 12 at these times. Once cutterhead 218 is positioned on surface 14, cylinder 258 retracts member 260 to its unlocking position to allow cutterhead 218 to rotate about axis 254 in response to changes in the contour of the surface 14. Axis 222 is parallel to axes 20 and 36 when the locking member 260 is in its locking position. Axis 222 is allowed to divert from this parallel orientation when the member is retracted to its unlocking position.

Apparatus 210 comprises a guide assembly 262 for each end of carriage 26, as illustrated, for example, with respect to one guide assembly in FIG. 9. Each guide assembly 262 comprises a hoop 264 and a plurality of rollers 266 associated therewith. Each hoop 264 is coupled to base 48. Rollers 266 of each guide assembly 262 are coupled to an associated support plate 33 and are configured to move along the associated hoop 264 when carriage 26 oscillates about axis 20. Each roller 266 has a groove for engagement with its associated hoop 264. Alternatively, each guide assembly 262 is a rotary bearing for supporting the respective end of carriage 26 when carriage 26 oscillates about axis 20.

Apparatus 210 comprises a carriage oscillator 250, as illustrated, for example, in FIG. 9. Carriage oscillator 250 comprises a gear motor 276, a crank arm 278, and a connector arm 280. Motor 276 has an axis-of-rotation 281. Crank arm 278 is coupled to motor 276 at axis-of-rotation 281. Crank arm 278 is also coupled to connector arm 280 at a rotation point 282 so that crank arm 278 and connector arm 280 are relatively movable. Connector arm 280 is coupled to one of plates 33 at another rotation point 284 so that connector arm and plate 33 are relatively movable. Carriage oscillator 250 further comprises a ring bearing (not illustrated) to support plate 33 during oscillation of carriage 26. The ring bearing is positioned radially inwardly from hoop 264.

Operation of motor 276 causes crank arm 278 to move in direction 286 about axis-of-rotation 281, or, alternatively, in a direction opposite to direction 286. The portion of connector arm 280 coupled to crank arm 278 at point 282 moves with crank arm 278 thereby causing connector arm 280 to oscillate carriage 26. Illustratively, the angle through which carriage 26 oscillates is between about 22.5° and about 30°. Together, the carriage 26, base 48, guide assemblies 262, and carriage oscillator 250 provide a cutterhead mover 224 for moving the cutterheads 218 on the surface 14.

In some embodiments of flitch surfacer 13, guide assemblies 262 are employed in the manner described in connection with apparatus 210. In some embodiments of flitch surfacer 13, carriage oscillator 250 is employed in place of carriage oscillator 50 in the manner disclosed in connection with apparatus 210.

Figure 14:
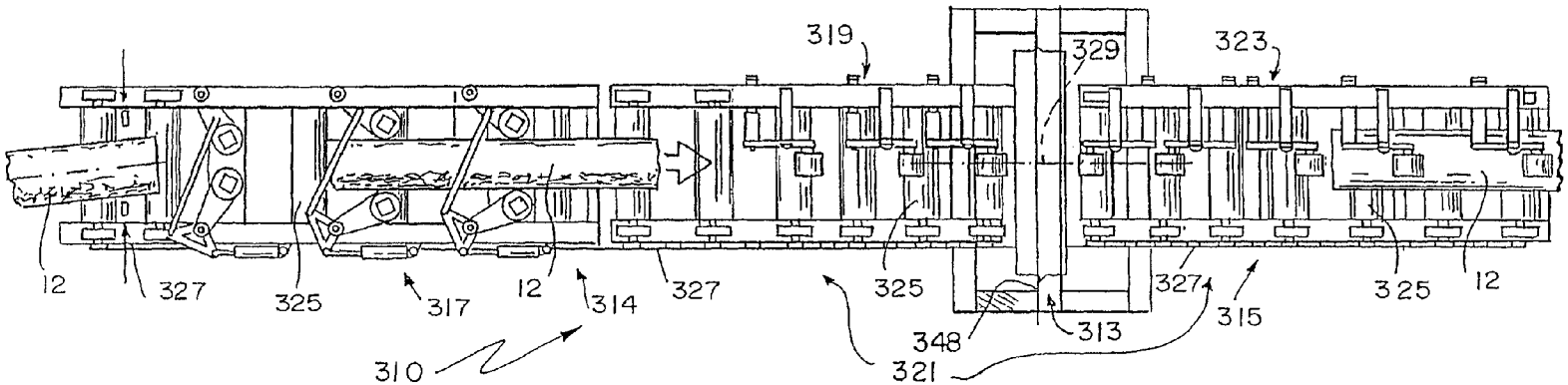
FIG. 14 is a top plan view of the apparatus of FIG. 13.
Figure 13:
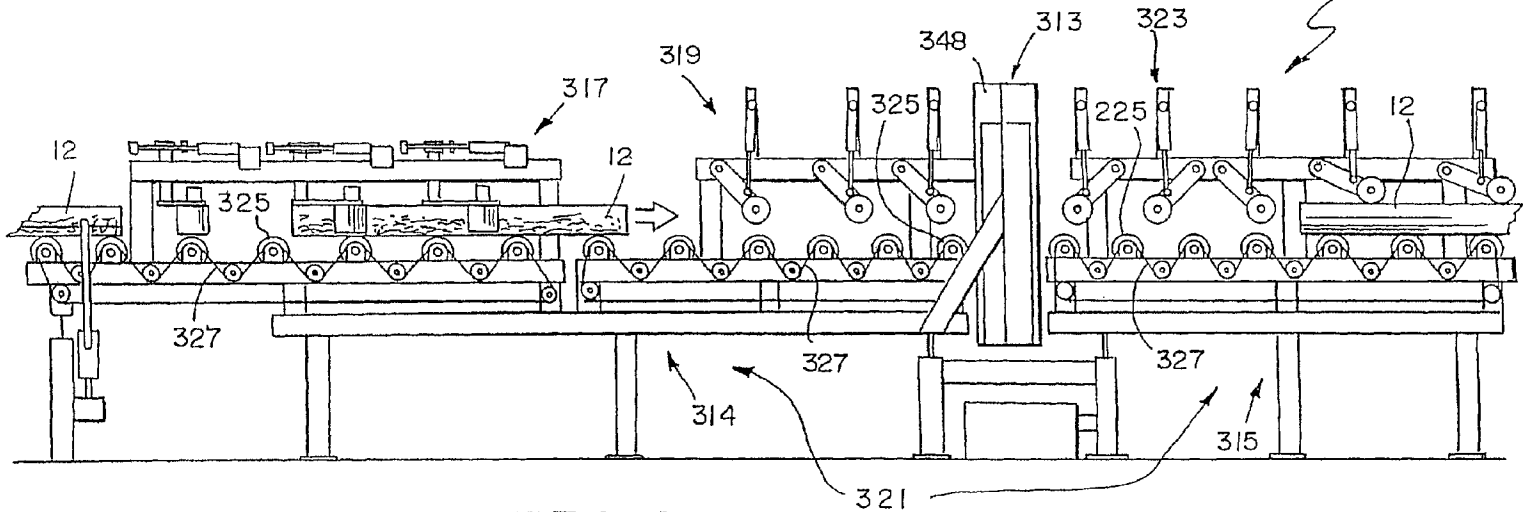
FIG. 13 is a side elevation view of another apparatus for surfacing a flitch.

Another apparatus 310 for surfacing the flitch 12 to prepare the flitch 12 for veneer slicing or other purposes is illustrated in FIGS. 13 and 14. The apparatus 310 comprises a flitch surfacer 313 for surfacing the flitch 12 by cutting material from its radially outer surface 14. The flitch surfacer 313 comprises a cutterhead 318 and a cutterhead mover 324 to move the cutterhead 318 on the flitch 12 circumferentially thereabout for the cutterhead 318 to cut material from the radially outer surface 14 of the flitch 12. The cutterhead mover 324 is configured to move the cutterhead 318 completely around the flitch 12 (instead of oscillating like embodiments discussed above) to cut material from the surface 14. The illustrative flitch surfacer 313 comprises three cutterheads 318 to be moved completely around the flitch 12 by the cutterhead mover 324. It is within the scope of this disclosure for the flitch surfacer 313 to comprise any number of cutterheads 318. Further details of the apparatus 310 are now discussed.

The apparatus 310 comprises a flitch support 321, as illustrated in FIGS. 13 and 14. An infeed conveyor device 314 of the flitch support 321 is configured to feed the flitch 12 into the flitch surfacer 313 to be surfaced thereby. An outfeed conveyor device 315 of the flitch support 321 is configured to receive the surfaced flitch 12 from the flitch surfacer 313 and to carry it away therefrom. Each of the infeed and outfeed conveyor devices 314, 315 comprises a plurality rollers 325 rotated by one or more belts 327 driven by one or more belt drivers to move a flitch 12 on the rollers 325. It is within the scope of this disclosure for the flitch support 321 to move a flitch 12 in a continuous manner through the surfacer 313 or in an incremental or manner through the surfacer 313.

The apparatus 310 comprises a flitch centering unit 317, an infeed press-roll unit 319, and an outfeed press-roll unit 324, as illustrated in FIGS. 13 and 14. The flitch centering unit 317 is configured to center the flitch 12 as the flitch 12 passes thereby to orient the flitch 12 so that its central longitudinal axis is generally coextensive with a central longitudinal axis of the flitch support 321 before it arrives at the infeed press-roll unit 319 and the flitch surfacer 313. The infeed and outfeed press-roll units 319, 324 comprise a number of downwardly acting press-rolls to maintain the flitch 12 in the orientation established by the centering unit 317 as the flitch 12 enters and exits the flitch surfacer 313.

Figure 15:
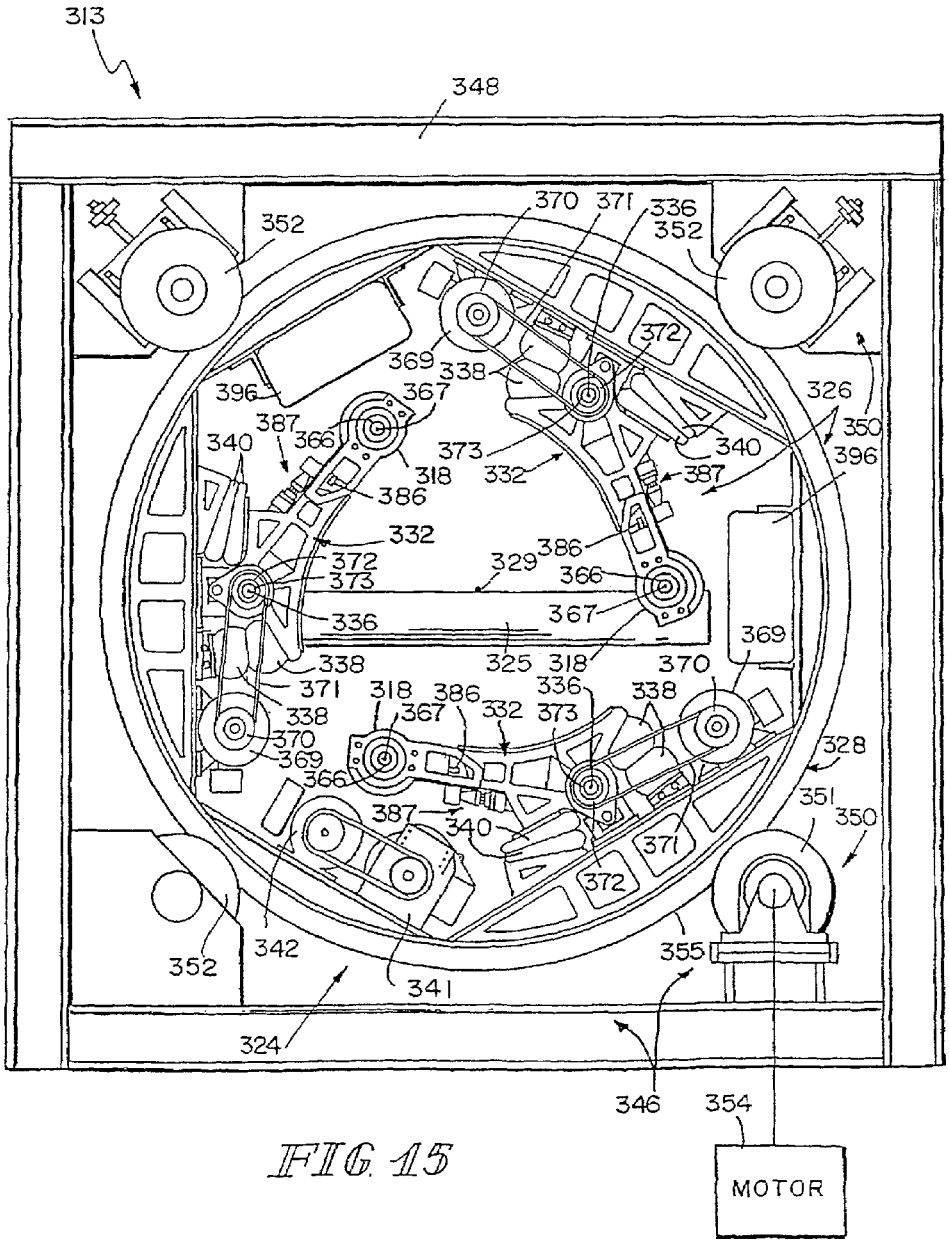
FIG. 15 is an infeed elevation view of a flitch surfacer of the apparatus of FIGS. 13 and 14 showing the flitch surfacer comprising cutterheads coupled to a rotatable carriage and retracted to a radially outer position.
Figure 16:
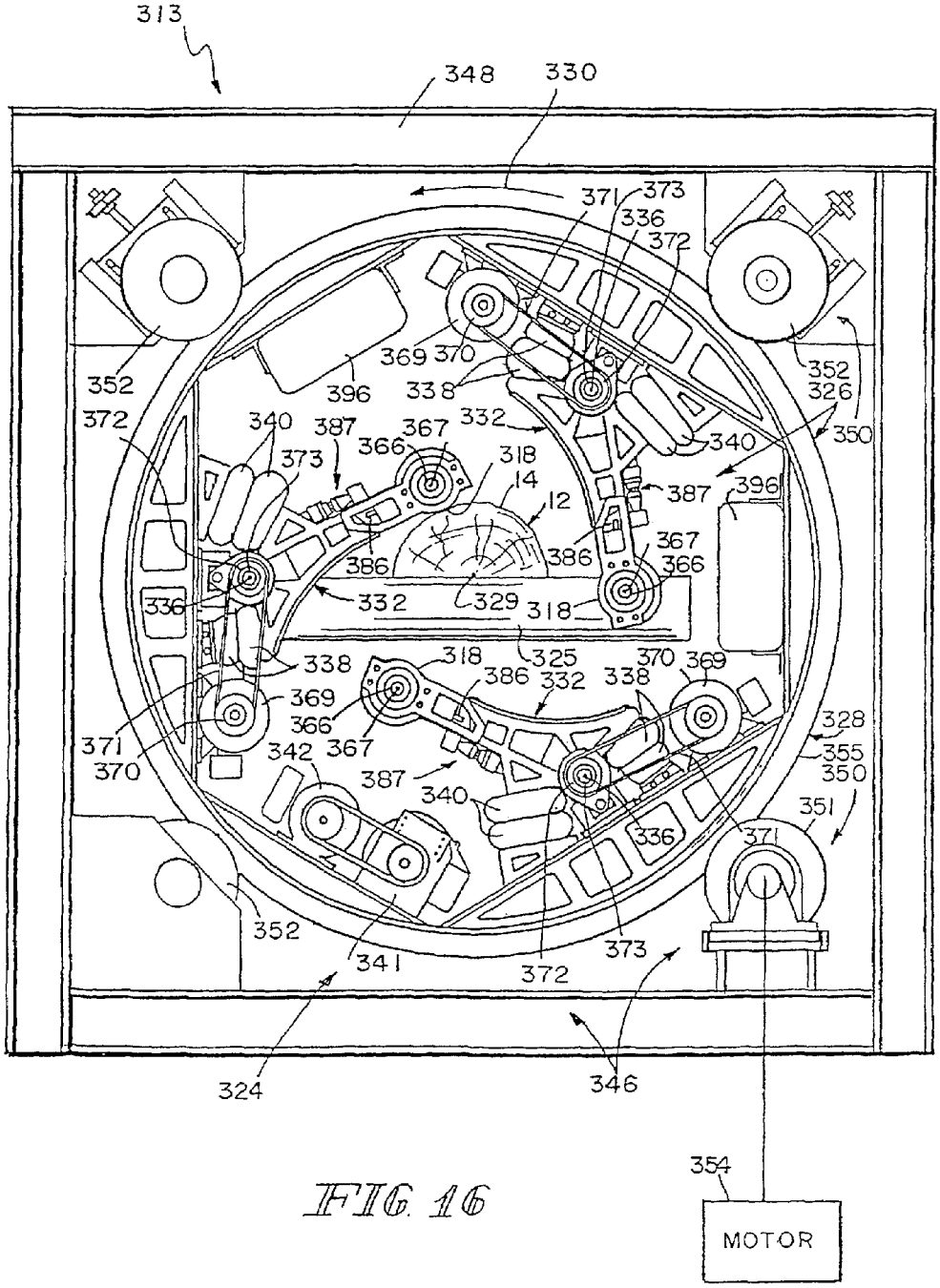
FIG. 16 is an infeed elevation view similar to FIG. 15 showing the cutterheads deployed to a radially inner position to cut material from the radially outer surface of the flitch as the carriage rotates about the flitch.

The cutterhead mover 324 comprises a rotatable carriage 326 to carry the cutterheads 318 and a carriage support 346 to support the carriage 326, as illustrated in FIGS. 15 and 16. The carriage 326 is configured to surround the flitch 12 and the cutterheads 318 are coupled to the carriage 326 for rotation therewith (such as in direction 330 illustrated in FIG. 16 or, in some embodiments, in a direction opposite to direction 330) about the flitch 12 to cut material from surface 14. The carriage 326 comprises a rotatable ring 328 configured to surround the flitch 12 for rotation thereabout to move the cutterheads 318 on the flitch 12 circumferentially thereabout to cut material from surface 14. In particular, the ring 328 is rotatable about an axis 329 (see FIGS. 15 and 16) which is coextensive with a central axis of the ring 328 and the central longitudinal axes of the flitch 12 and the flitch support 321. Each cutterhead 318 is coupled to the ring 328 by an associated pivot arm 332.

The carriage support 346 comprises a carriage mover configured as a ring rotator 350 to rotate the ring 328 and a rotator support 348 to support the ring rotator 350, as illustrated in FIGS. 15 and 16. The rotator 350 comprises a drive wheel 351, idler wheels 352, and a motor 354. Each of the drive and idler wheels 350, 351 comprises a groove (not illustrated) to receive a V-shaped peripheral angle 355 of the ring 328. The motor 354 is coupled to the drive wheel 351 for rotation thereof to rotate the ring 328 and thus the cutterheads 318 completely around the flitch 12. It is within the scope of this disclosure to control the motor 354 in such a way so as to rotate the ring 328 and thus the cutterheads 318 only partially around the flitch 12 in an oscillating or non-oscillating manner. It is also within the scope of this disclosure for the carriage support 346 to be without the motor 354 so as to be rotatable by hand.

The two top idler wheels 352 are coupled to the rotator support 348 for adjustment between ring retaining and ring releasing positions to facilitate insertion, retention, and removal of the ring 328. In the ring retaining position (see FIGS. 15 and 16), the two top idler wheels 352 are configured for engagement with the angle 355 for retention thereof in place. In the ring releasing position (not illustrated), the two top idler wheels 352 are configured for disengagement with the angle 355 to allow insertion of the ring 328 into the surfacer 313 or removal of the ring 328 from the surfacer 313.

In some embodiments, the ring rotator 348 is replaced by a ring rotator that comprises a large diameter slewing ring bearing. In particular, such a ring bearing comprises a stationary portion and a rotatable portion mounted for rotation on the stationary portion. The stationary portion is fixed to a stationary frame. The ring 328 is coupled to the rotatable portion for rotation therewith about the flitch 12 to rotate the cutterheads 318 about the flitch to cut material from the radially outer surface 14.

The cutterhead mover 324 comprises a radial motion device for movement of the cutterheads 318 radially toward and radially away from the radially outer surface 14. The radial motion device comprises the pivot arms 332 (see FIGS. 15 and 16) and a pivot arm mover 334 (see FIG. 17) to move each pivot arm 332 about a pivot axis 336 (see FIGS. 15, 16, and 18) radially toward and radially away from the surface 14. The pivot axes 336 are parallel to the axis 329. The pivot arm mover 334 is a pneumatic system. It is within the scope of this disclosure for the pivot arm mover 334 to use other types of fluid such as hydraulic fluid.

The pivot arm mover 334 comprises a set of high pressure air bags 338 for each pivot arm 332 and a set of low pressure air bags 340 for each pivot arm 332, as illustrated in FIGS. 15-16. The pivot arm mover 334 controls movement of the pivot arms 332 toward and away from the surface 14 by deflation and inflation, respectively, of the high pressure air bags 338 while maintaining the air pressure in the low pressure air bags 340 constant. The high pressure air bags 338 contain a higher air pressure than the low pressure air bags 340 when the air bags 338, 340 are inflated. When inflated, the high pressure air bags 338 and the low pressure air bags 340 contain air pressures of, for example, 45 psi and 12 psi, respectively. As such, the high pressure air bags 338 move the pivot arms 332 about the pivot axes 336 against the inflated low pressure air bags 340 radially away from the surface 14 upon inflation of the high pressure air bags 338, as illustrated in FIG. 15. The low pressure air bags 340 move the pivot arms 332 about the pivot axes 336 radially toward the surface 14 upon deflation of the high pressure air bags 338, as illustrated in FIG. 16.

Figure 17:
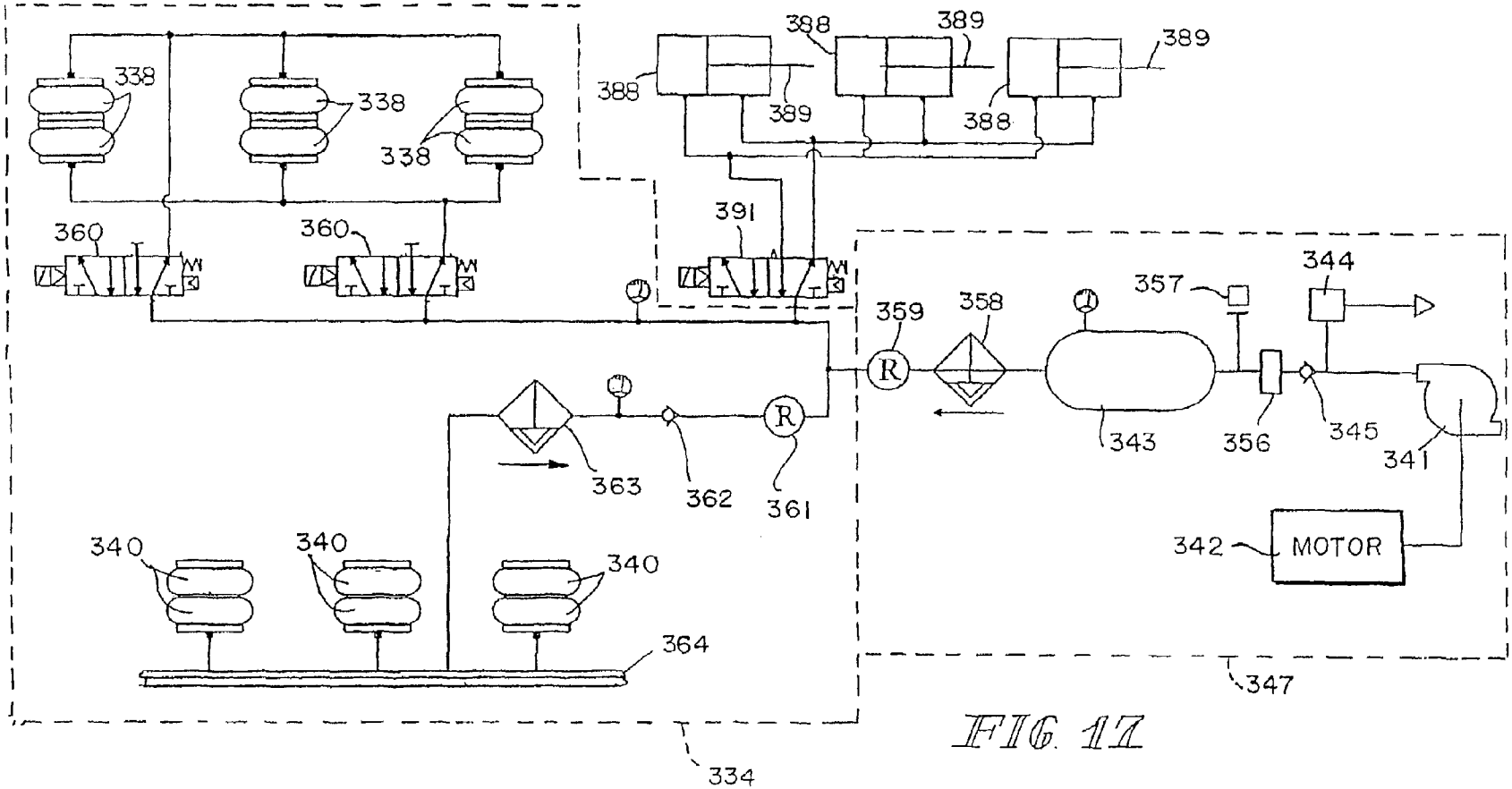
FIG. 17 is a pneumatic diagram of components of the flitch surfacer of FIGS. 15 and 16.

An air supply 347 is coupled to the pivot arm mover 334 to supply pressurized air thereto, as illustrated diagrammatically in FIG. 17. The air supply 347 comprises an air compressor 341 (see also FIGS. 15 and 16) to supply pressurized air for the air bags 338, 340 and a motor 342 (see also FIGS. 15 and 16) to operate the compressor 341. The compressor 341 and motor 342 are mounted onboard the ring 328 for rotation therewith. The compressor 341 supplies pressurized air to an air reservoir 343 which is set, for example, to 85 psi. The illustrative air reservoir 343 is configured as a pipe rolled onto the ring 328. In the air line between the compressor 341 and the reservoir 343 are a relief valve 344 (set, for example, at 100 psi), a check valve 345, a lock-out assembly 356, and a quick-disconnect 357. Downstream from the reservoir 343 are filter 358 and a pressure regulator 359. The pressure regulator 359 is set, for example, at 45 psi.

The pivot arm mover 334 is illustrated diagrammatically in FIG. 17. The air line downstream from the pressure regulator 359 branches into separate air lines to supply pressurized air to the high and low pressure air bags 338, 340. Air flow to the high pressure air bags 338 is controlled by valves 360. Each valve 360 controls air flow to one of the high pressure air bags 338 of each set of the high pressure air bags 338. Air flow to the low pressure air bags 340 passes in series from the pressure regulator 359 through another pressure regulator 361, a check valve 362, a filter 363, and an air reservoir 364. The pressure regulator 361 is set, for example, at 12 psi and maintains the low pressure air bags 340 at a constant pressure so that the pivot arms 332 will press the cutterheads 318 against the surface 14 at a constant pressure when the cutterheads 318 are positioned on the surface 14 and the high pressure air bags 338 are deflated. The illustrative air reservoir 364 is another pipe rolled onto the ring 328. It is within the scope of this disclosure to omit check valve 362.

Air may be delivered to the air bags 338, 340 by other mechanisms. For example, the compressor 341 and motor 342 may be mounted off the ring 328. In such a case, the compressor may deliver air to a fixed member which is fixed to the rotator support. The fixed member seals against a rotating member coupled to the ring 328 for rotation therewith and delivers air to the rotating member for eventual delivery to the high and low pressure air bags 338, 340.

The apparatus 312 comprises a flitch position detector (not illustrated) to track the position of a flitch 12 approaching and passing through the surfacer 313. In one embodiment, the flitch position detector comprises a photosensor that senses the leading and trailing portions of the flitch 12. The flitch position detector further comprises a counter with a toothed wheel coupled to one of the rollers 325 over which the flitch 12 passes to determine when the leading and trailing portions detected by the photosensor will arrive at the surfacer 313.

The apparatus 310 uses the flitch position information obtained by the flitch position detector to control operation of the pivot arm mover 334. The pivot arm mover 334 moves the pivot arms 332 and cutterheads 318 from a radially outer position (see FIG. 15) to a radially inner position (see FIG. 16) in response to tracking of the leading portion of the flitch 12 by the flitch position detector. The pivot arm mover 334 moves the pivot arms 332 and cutterheads 318 from the radially inner position to the radially outer position in response to tracking of the trailing portion of the flitch 12 by the flitch position detector.

Figure 18:
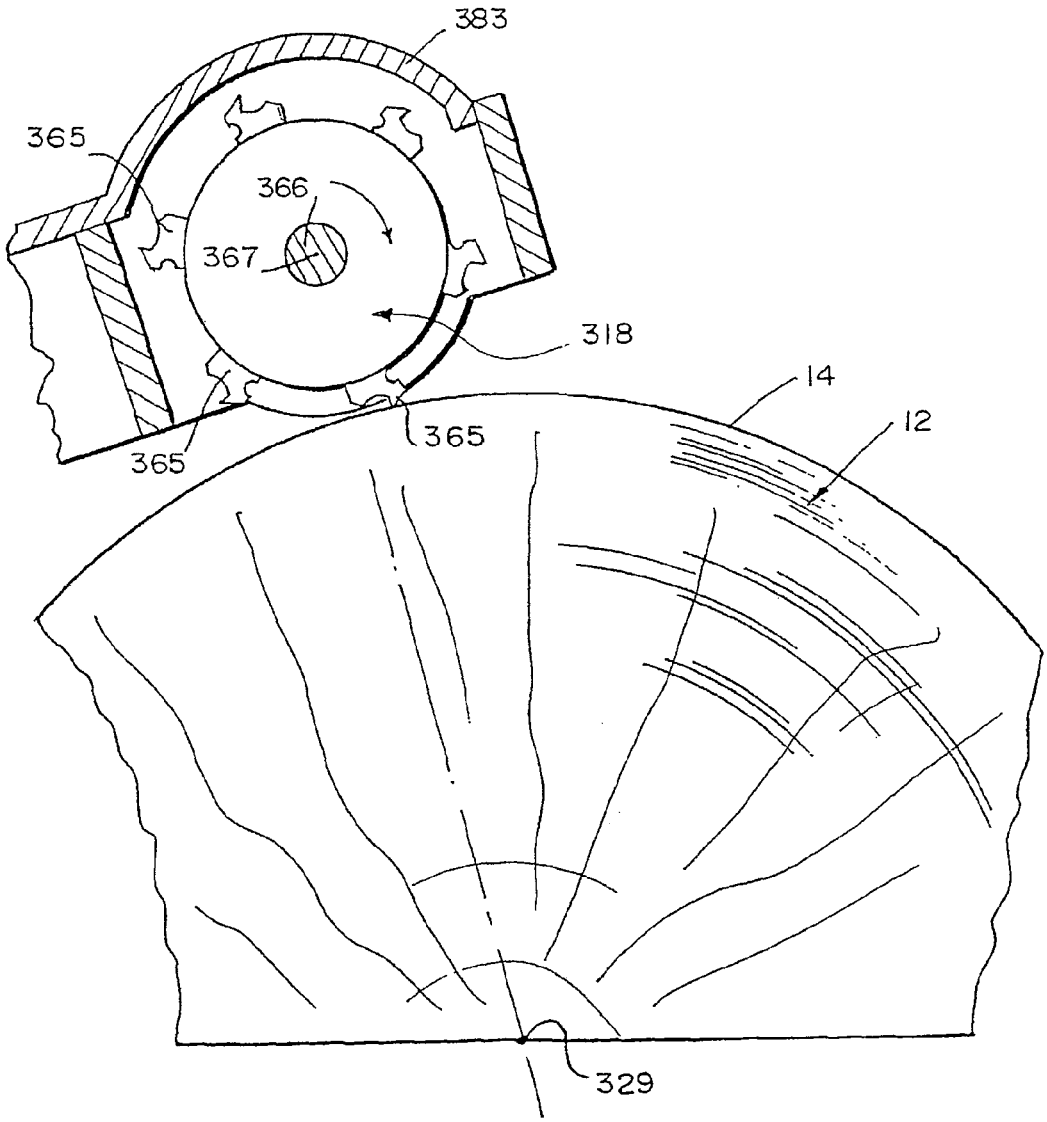
FIG. 18 is a fragmentary sectional view of one of the cutterheads of FIGS. 15 and 16.

One of the cutterheads 318 is illustrated in FIG. 18. Each cutterhead 318 illustratively comprises six knives 365 for cutting material from the surface 14 and a rotatable cutterhead shaft 366 for rotating the knives 365 around a cutterhead axis 367 defined by the shaft 366. The cutterhead shaft 366 is supported by a pair of bearings (not illustrated) for rotation therein. It is within the scope of this disclosure for each cutterhead 318 to have any number of knives 365. A cutterhead which may be used for each of the cutterheads 318 can be obtained from Terminus, Inc. located in St. Louis, Mo. and has model number 9000178230650.

Figure 19:
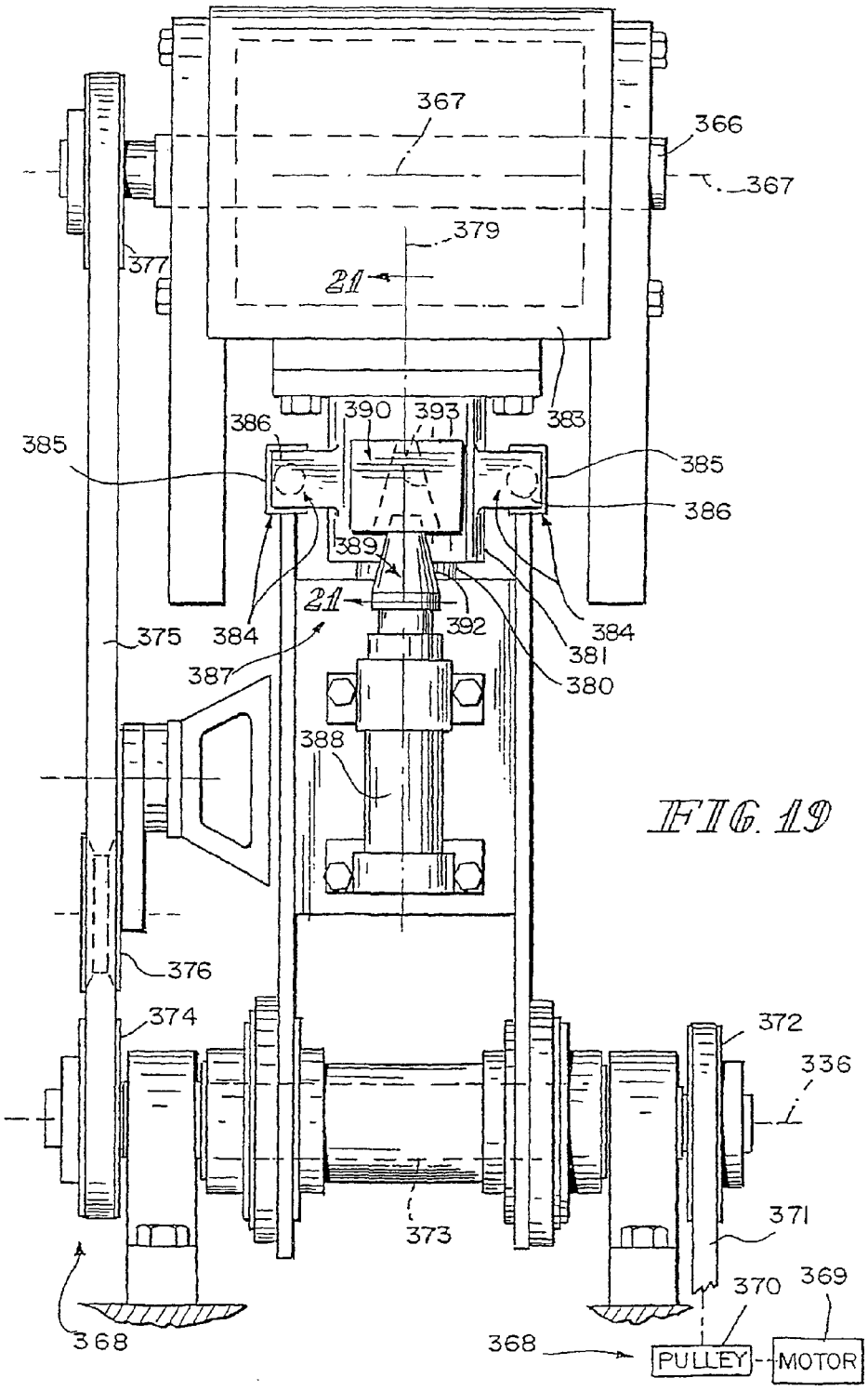
FIG. 19 is a top plan view of components of the flitch surfacer of FIGS. 15 and 16 showing a cutterhead (at top of page), belts, pulleys, and a motor for operating the cutterhead, and a pivot arm to move the cutterhead about a pivot axis.

Each cutterhead 318 is driven by a cutterhead driver 368, as illustrated with respect to one of the cutterhead drivers 368 in FIG. 19. Each cutterhead driver 368 comprises a motor 369 which turns a pulley 370 to move a belt 371 (see also FIG. 20) entrained about the pulley 370 and a pulley 372 (see also FIG. 20). The pulley 372 rotates a cutterhead driver shaft 373 (see also FIGS. 20 and 22) which extends through an inner end of the associated pivot arm 332 and defines the pivot axis 336 therefor. The cutterhead driver shaft 373 turns a pulley 374 to move a belt 375 entrained about a belt tensioner 376 and a pulley 377, as illustrated also in FIG. 22. The pulley 377 is coupled to the cutterhead shaft 366 for rotation of the cutterhead shaft 366 and thus the knives 365 about the cutterhead axis 367.

Figures 20, 21:
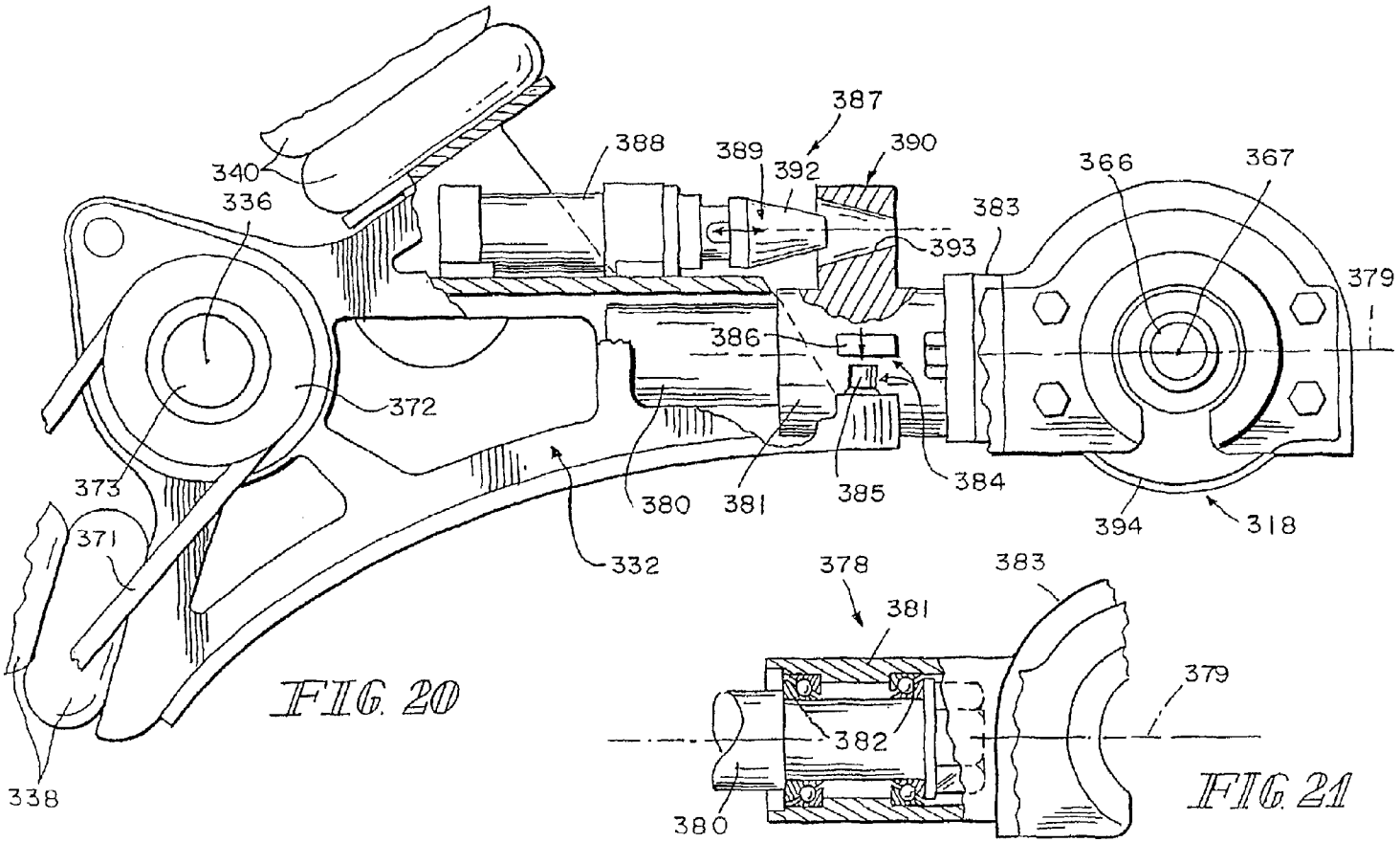
FIG. 20 is an infeed elevation view of components of FIG. 20 showing a locking device with a locking member in an unlocking position to allow rotation of the cutterhead in response to changes in the contour of the radially outer surface.
FIG. 21 is a sectional view taken along lines 21-21 of FIG. 19 showing a flitch contour accommodation device to allow rotation of the cutterhead in response to changes in the contour of the radially outer surface of the flitch.

The surfacer 313 comprises a flitch contour accommodation device 378 for each cutterhead 318, as illustrated with respect to one of the devices 378 in FIGS. 20 and 21. Each device 378 is configured to allow rotation of the associated cutterhead 318 about a device axis 379 transverse to the associated cutterhead axis 367 in response to changes in the contour of surface 14, as illustrated in FIG. 25. Each device axis 379 is perpendicular to the associated cutterhead axis 367, as suggested in FIGS. 19 and 20. It is within the scope of this disclosure for each device axis 379 to be at other angles to the associated cutterhead axis 367.

Each device 378 comprises a post 380, a sleeve 381, and a pair of bearings 382, as illustrated in FIG. 21. The post 380 is fixed to the associated pivot arm 332. The sleeve 381 is fixed to a housing 383 of the associated cutterhead 318 and receives the post 380. The bearings 382 are positioned between the post 380 and sleeve 381 for rotation of the sleeve 381 about the post 380 for rotation of the associated cutterhead 318 about the device axis 379 which is defined by the post 381. The bearings 382 may be, for example, tapered bearings.

Figure 22:
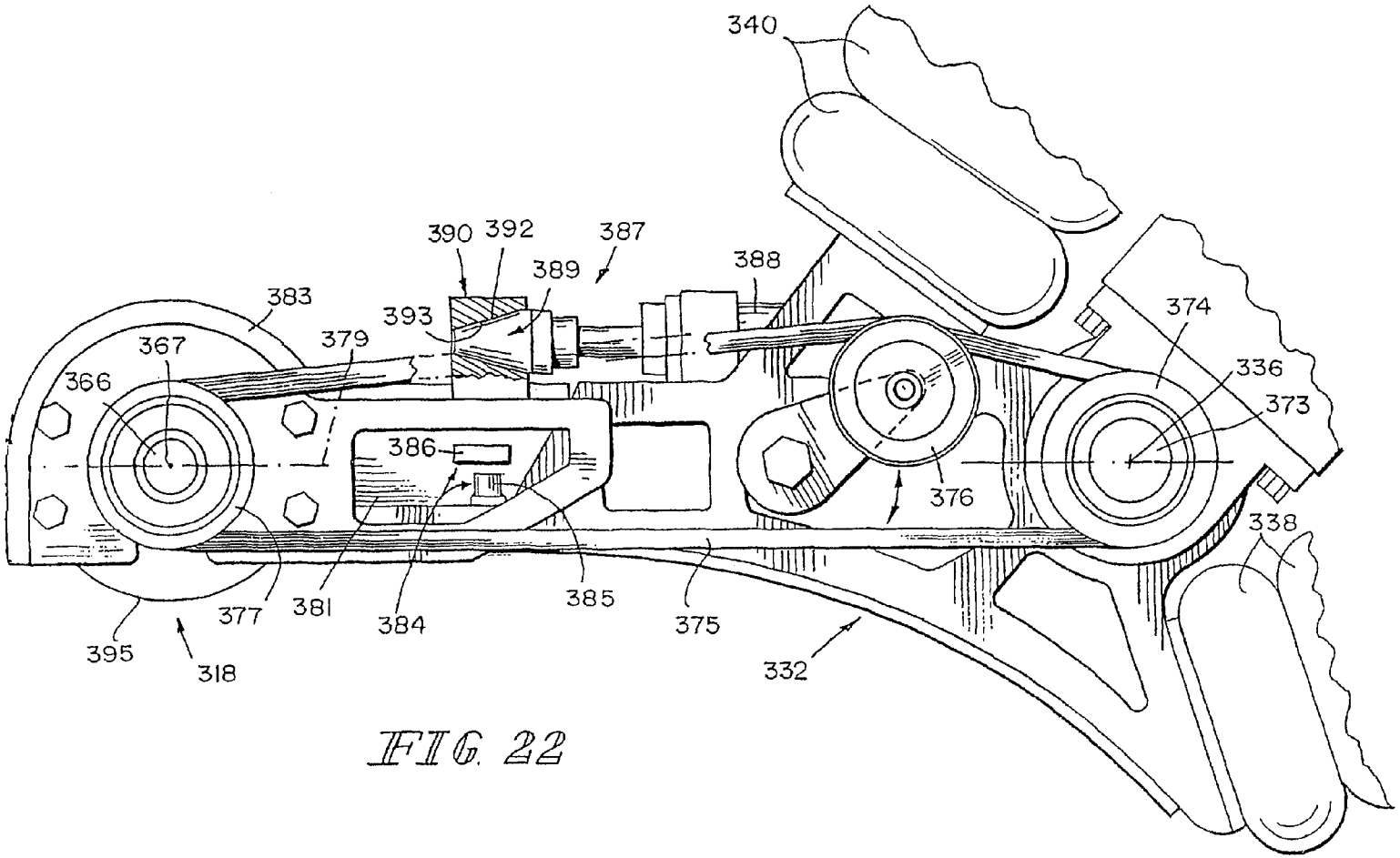
FIG. 22 is an outfeed elevation view of components of FIG. 20 showing the locking member of the locking device in a locking position to block rotation of the cutterhead that could be caused by changes in the contour of the radially outer surface.

Each device 378 further comprises a pair of rotation limiters 384 to limit rotation of the associated cutterhead 318 about the device axis 379, as illustrated in FIGS. 20 and 22. It is within the scope of this disclosure for each device 378 to comprise any number of rotation limiters 384. Each rotation limiter 384 comprises a bumper 385 coupled to the associated pivot arm 332 and a flange 386 coupled to the sleeve 381 to engage the bumper 385 upon rotation of the associated cutterhead 318 a predetermined angle (e.g., 5°) measured between the associated cutterhead axis 367 and a horizontal axis. The bumper 385 and flange 386 of one of the rotation limiters 384 are coupled to the infeed side of the associated pivot arm 332 and the infeed side of the sleeve 381, respectively, as illustrated in FIG. 20. The bumper 385 and flange 386 of the other rotation limiter 384 are coupled to the outfeed side of the associated pivot arm 332 and the outfeed side of the sleeve 381, respectively, as illustrated in FIG. 22.

The surfacer 313 comprises a locking device 387 for each cutterhead 318 to block rotation of the associated cutterhead 318 about the associated device axis 379, as illustrated in FIGS. 20 and 22. Each locking device 387 comprises an air cylinder 388, a locking member 389 extensible from the cylinder 388, and a locking member receiver 390. The cylinder 388 is fixed to the associated pivot arm 332. The locking member receiver 390 is fixed to the outer surface of the sleeve 381 for rotation with the sleeve 381 about the associated device axis 379.

The locking member 389 is configured for movement between an unlocking position (see FIGS. 20, 24, 25) and a locking position (see FIGS. 22, 23, and 26) in response to air pressure in the cylinder 388. In the unlocking position, the locking member 389 is retracted out of engagement with the receiver 390 and into the cylinder 388 to allow rotation of the associated cutterhead 318 about the associated device axis 379 in response to changes in the contour of the surface 14, as illustrated in FIG. 25. In the locking position, the locking member 389 is extended from the cylinder 388 into engagement with the receiver 390 to block rotation of the associated cutterhead 318 about the associated device axis 379. The locking member 389 and the receiver 390 comprise an external conical surface 392 and an internal conical surface 393, respectively, which disengage one another in the unlocking position and engage one another in the locking position. Movement of the locking member 389 between the unlocking and locking positions is controlled by a valve 391 coupled to the cylinder 388 and coupled to the air supply 347 to receive pressurized air therefrom, as illustrated in FIG. 17.

The position of each cutterhead axis 367 relative to the axis 329 is influenced by whether the associated locking member 389 is positioned in its locking or unlocking positions. For example, the cutterhead axis 367 is parallel to the axis 329 when the associated locking member 389 is positioned in its locking position. On the other hand, when the associated locking member 389 is positioned in its unlocking position, the cutterhead axis 367 is free to rotate about the associated device axis 379 to an orientation non-parallel with the axis 329.

Referring now to FIGS. 23-26, an infeed cut-depth limiter 394 and an outfeed cut-depth limiter 395 is coupled to each cutterhead housing 383. The cut-depth limiters 394, 395 establish the depth of cut of the knives 365 into the surface 14 and are adjustable to change the cut depth. The infeed cut-depth limiter 394 allows a greater depth of cut than the outfeed cut-depth limiter 395 since it extends a shorter distance away from the associated cutterhead axis 367 than the outfeed cut-depth limiter 395.

Whether a locking member 389 is to be positioned in its unlocking position or its locking position is determined by whether the associated cut-depth limiters 394, 395 are positioned on the surface 14. When neither of the associated cut-depth limiters 394, 395 is positioned on the surface 14 or when only one of the associated cut-depth limiters 394, 395 is positioned on the surface 14, the locking member 389 is positioned in its locking position to prevent the associated cutterhead 318 from canting and thereby possibly gouging surface 14 as the associated cutterhead 318 moves onto (see FIG. 23) or off (see FIG. 26) the surface 14. The locking member 389 is positioned in its unlocking position when both of the associated cut-depth limiters 394, 395 are positioned on the surface 14, as illustrated in FIGS. 24 and 25.

The apparatus 310 uses the flitch position detector to determine whether none, one, or both of the associated cut-depth limiters 394, 395 are positioned on the surface 14. The flitch position detector is configured to track the position of the leading and trailing portions of the flitch 12. The apparatus 310 uses this information to control operation of the locking devices 387.

The surfacer 310 comprises an electrical control system housed in a pair of electrical boxes 396, as illustrated in FIGS. 15 and 16. The electrical control system controls operation of electrical systems of the surfacer 310 such as the valves 360, 391, the motors 342, 369, and the compressor 341.

It is within the scope of this disclosure for the cutterhead mover 324 to be configured to oscillate the cutterheads 318 back and forth on the flitch 12. For example, the cutterhead mover 324 may be configured to oscillate the cutterheads 318 on the flitch 12 without moving the cutterheads 318 completely around the flitch 12.

In some embodiments, the cutterheads 318 are mounted to the ring 328 for movement radially inwardly and outwardly along a respective radius extending from axis 329. In particular, the pivot arms 322 are replaced by one or more devices to provide such radial movement of the cutterheads 318. The cutterheads 318 can be moved radially when the ring 328 is rotating or when the ring 328 is stationary.

Although certain illustrative embodiments have been disclosed in detail, variations and modifications exist within the scope and spirit of the invention as described and defined in the following claims.

What is claimed is:

1. An apparatus for surfacing a flitch by cutting material from the flitch's radially outer surface to prepare the flitch for veneer slicing or other uses, the apparatus comprising a cutterhead having a first axis about which the cutterhead rotates and a first cutterhead oscillator to oscillate the cutterhead about a second axis back and forth about the flitch as the flitch passes the cutterhead to cut material from the radially outer surface of the flitch, the second axis extending generally in the direction of motion of the flitch past the cutterhead, and a second cutterhead oscillator coupled to the first cutterhead oscillator and the cutterhead to oscillate the cutterhead back and forth about a third axis transverse to the first axis.

2. The apparatus of claim 1 comprising a flitch support to support the flitch as the flitch passes the cutterhead, a longitudinal axis of the flitch support being generally coextensive with the second axis.

3. The apparatus of claim 2 wherein the first cutterhead oscillator comprises a pivot arm having a fourth axis about which the pivot arm is pivotable to move the first axis radially toward and radially away from the radially outer surface of the flitch, the fourth axis being generally parallel to the first axis.

4. The apparatus of claim 3 wherein the first cutterhead oscillator comprises a cam and a cam follower to follow the cam to oscillate the cutterhead.

5. The apparatus of claim 1 wherein the second cutterhead oscillator comprises a flitch contour accommodation device to allow movement of the cutterhead in response to changes in the contour of the radially outer surface of the flitch.

* * * * *